US007856837B2

(12) United States Patent
Yamashita et al.

(10) Patent No.: US 7,856,837 B2
(45) Date of Patent: Dec. 28, 2010

(54) AIR CONDITIONING EQUIPMENT, FAN EQUIPMENT, METHOD OF REDUCING NOISE OF EQUIPMENT, PRESSURE PULSATION REDUCER FOR REFRIGERATION CYCLE EQUIPMENT, PRESSURE PULSATION REDUCER FOR PUMP EQUIPMENT AND METHOD OF REDUCING PRESSURE PULSATION OF EQUIPMENT

(75) Inventors: Kouji Yamashita, Tokyo (JP); Tsuyoshi Uchida, Tokyo (JP); Tatsuya Ishii, Tokyo (JP); Katsumi Takeda, Tokyo (JP); Hideshi Oinuma, Tokyo (JP); Kenichiro Nagai, Tokyo (JP)

(73) Assignees: Mitsubishi Denki Kabushiki Kaisha, Chiyoda-Ku, Tokyo (JP); Japan Aerospace Exploration Agency, Chofu-shi, Tokyo (JP)

( * ) Notice: Subject to any disclaimer, the term of this patent is extended or adjusted under 35 U.S.C. 154(b) by 671 days.

(21) Appl. No.: 10/529,870

(22) PCT Filed: Aug. 26, 2003

(86) PCT No.: PCT/JP03/10741

§ 371 (c)(1),
(2), (4) Date: Jan. 12, 2006

(87) PCT Pub. No.: WO2004/031660

PCT Pub. Date: Apr. 15, 2004

(65) Prior Publication Data

US 2007/0060038 A1 Mar. 15, 2007

(30) Foreign Application Priority Data

Feb. 10, 2002 (JP) ..... 2002-289663

(51) Int. Cl.
*F25B 1/32* (2006.01)

(52) U.S. Cl. ..... 62/238.7; 62/324.1

(58) Field of Classification Search ..... 454/248; 62/238.7, 259, 296, 259.1, 160, 324.1; 181/210, 181/202, 203, 286, 238, 284, 288, 293, 290, 181/292, 213–218; 138/26
See application file for complete search history.

(56) References Cited

U.S. PATENT DOCUMENTS 2,875,787 A * 3/1959 Evans ..... 138/30

(Continued)

FOREIGN PATENT DOCUMENTS

EP 0 926 452 6/1999

(Continued)

OTHER PUBLICATIONS

Abstract of JP11-107959 A to Fijiwara et al.*

(Continued)

*Primary Examiner*—Mohammad M Ali
(74) *Attorney, Agent, or Firm*—Buchanan Ingersoll & Rooney PC

(57) ABSTRACT

Air conditioning equipment that ensures sufficient noise reduction in the low frequency range of a few hundred hertz or below. The air conditioning equipment is characterized by including a heat exchanger for exchanging heat between air and refrigerant of a refrigeration cycle, a fan that supplies air to the heat exchanger, an air duct in which the fan is installed and through which acoustic waves are propagated, and a plurality of small holes that blows a jet into the air duct and sucks a jet from the air duct by a pressure difference between the blow side and the suction side of the fan.

5 Claims, 27 Drawing Sheets

U.S. PATENT DOCUMENTS

| | | | | |
|---|---|---|---|---|
| 3,070,977 | A | | 1/1963 | Kimmel et al. |
| 4,381,651 | A | | 5/1983 | Kubo et al. |
| 4,652,217 | A | * | 3/1987 | Shibuya ..... 417/269 |
| 5,638,940 | A | | 6/1997 | Aoyama et al. |
| RE37,120 | E | | 4/2001 | Aoyama et al. |
| 6,772,856 | B2 | | 8/2004 | Ishii |
| 2003/0006089 | A1 | | 1/2003 | Ishii |

FOREIGN PATENT DOCUMENTS

| | | | | |
|---|---|---|---|---|
| JP | SHO 57-173686 | | | 10/1982 |
| JP | SHO 58-194908 | | | 12/1983 |
| JP | 59-21951 | A | | 2/1984 |
| JP | 61-003943 | | | 1/1986 |
| JP | 04-369342 | | | 12/1992 |
| JP | 07-247905 | | | 9/1995 |
| JP | 08-014704 | A | | 1/1996 |
| JP | 08-143-149 | | | 6/1996 |
| JP | 08-143149 | | | 6/1996 |
| JP | 09-112488 | | | 5/1997 |
| JP | 11-107959 | A | * | 4/1999 |
| JP | 2000-292077 | A | | 10/2000 |
| JP | 2002-250535 | | | 9/2002 |
| JP | 2002-350003 | A | | 12/2002 |
| JP | 2003-015656 | | | 1/2003 |
| WO | WO 97/21024 | | | 6/1997 |

OTHER PUBLICATIONS

English translation to JP 11-107959 A to Fujiwara et al.*

Howe, M. S. "*Attenuation of sound in a low Mach number nozzle flow*." J. Fluid Mech. vol. 91, Part 2. pp. 209-229. 1979.

Bechert, D. W. "*Sound Absorption Caused by Vorticity Shedding, Demonstrated With a Jet Flow*." Journal of Sound and Vibration. vol. 70 (3). pp. 389-405. 1980.

Japan Patent Office. International Patent Application No. PCT/JP03/10741. Nov. 25, 2003. 2 pages.

Supplementary European Search Report Application/Patent No. 03799088.4-2301dated Feb. 12, 2008.

Extended European Search Report and Written Opinion dated Jan. 13, 2010.

* cited by examiner

AIR CONDITIONING EQUIPMENT, FAN EQUIPMENT, METHOD OF REDUCING NOISE OF EQUIPMENT, PRESSURE PULSATION REDUCER FOR REFRIGERATION CYCLE EQUIPMENT, PRESSURE PULSATION REDUCER FOR PUMP EQUIPMENT AND METHOD OF REDUCING PRESSURE PULSATION OF EQUIPMENT

TECHNICAL FIELD

The present invention relates to noise reduction of air conditioning equipment such as a room air conditioner, noise reduction of fan equipment such as an indoor fan and an outdoor fan, a method for reducing noise of equipment in general, a pressure pulsation reducer of refrigeration cycle equipment, a pressure pulsation reducer of pump equipment, and a method for reducing pressure pulsation of equipment in general. A description will now be given with reference to air conditioning equipment, fan equipment, refrigeration cycle equipment and pump equipment as typical examples of equipment in general.

BACKGROUND ART

Among known conventional methods of noise reduction of air conditioning equipment are internal lining method of fan ducts with sound absorption materials and method using resonance.

With the internal lining method of fan ducts with sound absorption materials, inlet air is sent to a fan duct by the suction effect of the fan, but at the same time noise produced by the fan is also radiated into the fan duct. Noise is a collection of acoustic waves of various frequencies. Acoustic waves advance through the fan duct, reflecting on the duct wall. The sound absorption materials contain a lot of foam. Acoustic waves enter the sound absorption materials, while advancing through the fan duct, and cause diffuse reflection by the foam effect inside the sound absorption materials. As a result, the energy of the acoustic waves is converted into thermal energy whereby the energy level drops. In other words, the noise level drops. This explains the mechanism of noise reduction by sound absorption materials.

Because it is short-wavelength acoustic waves, however, that cause diffuse reflection inside sound absorption materials, high acoustic absorption effects are achieved mainly with high frequencies in general.

Among typical noise reduction methods is a Helmholtz resonator as an example of the method using resonance. The Helmholtz resonator is formed to include an opening inside a fan duct and space inside the resonator. With such construction, acoustic waves propagating through the fan duct enter the Helmholtz resonator where they resonate. Resonance causes the energy of acoustic waves to change to thermal energy. Thus, the noise level drops.

With the Helmholtz resonator, by the nature of the principle of resonance, the resonant wavelength of an acoustic wave is determined by the size of the entrance and the inner size of the resonator. In addition, it is only the acoustic wave whose frequency is high and near resonant frequency that is allowed to reduce the noise level.

Among other examples of the method using resonance is a noise reduction method using a perforated acoustic board that is provided with a perforated plate that is exposed on the inner surface of a duct and a back layer at the back thereof. This is a method of noise reduction by making acoustic waves resonate by a resonator that is formed by the perforated plate and the back layer. The principle and effect of this method are the same as those of the Helmholtz resonator.

According to the method using the perforated acoustic board, the frequency of absorbing sound depends on the diameter of the perforated plate, the thickness of the back layer, the open area ratio, and the board thickness. Therefore, low frequency noise can also be reduced depending on the design. This, however, requires a back layer of reasonable size. In addition, quite a large space is required for installation.

Among known conventional methods of reducing pressure pulsation of refrigeration cycle equipment or pump equipment is an expansion muffler that causes a loss of energy by means of diffuse reflection in an expanding part. The reduction effect of pressure pulsation by the expansion muffler covers broader bands. In order to further reduce the amount of pressure pulsation, however, the ratio of the diameter of the muffler must be increased at the entrance and exit of the expanding part. Good reduction in pressure pulsation thus requires quite a large space.

Japanese Unexamined Patent Publication No. 7-247905 discloses an embodiment of funning air to an air duct through a perforated plate. This is directed to reducing noise by funning air to the air duct so as to lower the temperature of the air of the air duct, thereby making acoustic waves to resonate with the perforated plate and the back layer thereof. Accordingly, this is entirely different in principles, actions and effects from the present invention.

Japanese Unexamined Patent Publication No. 8-143149 discloses an embodiment of exhausting air through a porous member of airflow resistance, which is attached to an exhaust hole. This is directed to reducing the sound of fluid jet by expanding an area to which the fluid jet blows so as to drop the fluid speed. Accordingly, this is entirely different in principles, actions and effects from the present invention, either.

The conventional noise reduction methods of air conditioning equipment thus configured are allowed only to reduce mostly high frequency noise. A problem is, therefore, that noise reduction effect cannot be expected for low frequency noise around a few hundred hertz or below that is most needed to be reduced in air conditioning equipment.

Another problem is posed with reference to the method using resonance. If noise level can be reduced in the low frequency range, the frequency band in which the noise reduction can effect is narrow. Therefore, if the rotational speed of a fan is changed by an inverter, an applied voltage or the like, the noise reduction effect can be expected only at some part of the rotational speed.

Another problem is posed with reference to quite a large space required to reduce noise level in the low frequency range. This makes it impossible to use the method for air conditioning equipment of limited size.

Another problem is posed with reference to noise generated by a fan blade or a fan that propagates to both directions, to the blow side and the suction side. In order to reduce this noise in both directions, a separate noise reduction mechanism is required on each side, which will make the structure complicated and require quite a large space for installation.

Another problem is posed with reference to space for pressure pulsation reduction. A substantial reduction in the pressure pulsation of refrigerant generated in refrigeration cycle equipment and the pressure pulsation of water or brine generated in pump equipment requires quite a large space.

The present invention is directed to solving the aforementioned problems. It is an object to provide air conditioning equipment, fan equipment, and a method of reducing noise of equipment that allow sufficient reduction effects of low frequency noise at a few hundred hertz or below.

Another object of the present invention is to provide air conditioning equipment, fan equipment, and a method of reducing noise of equipment that allow reducing low frequency noise in a wide frequency range.

Another object is to provide air conditioning equipment, fan equipment, and a method of reducing noise of equipment that do not require large space.

Another object is to provide air conditioning equipment, fan equipment, and a method of reducing noise of equipment of simple structure that use small space for installation by reducing noise in both directions, to the blow side and the suction side of a fan blade or fan based on one method of noise reduction.

Another object is to provide a low cost system that is structured so that when the rotational speed of the fan blade or fan equipment is changed, the frequency range or the acoustic pressure level in which the noise reduction can effect automatically changes in accordance with the rotational speed changed, by using a pressure difference between before and after a fan blade or fan equipment as a drive source.

Another object is to provide a method of reducing pressure pulsation that does not require large space.

DISCLOSURE OF THE INVENTION

Air conditioning equipment according to this invention is characterized by including a heat exchanger that exchanges heat between refrigerant of a refrigeration cycle and air; a fan that fans air to the heat exchanger; an air duct in which the fan is installed and through which an acoustic wave propagates; and a plurality of small holes that blows a jet to the air duct, and sucking a jet from the air duct according to a pressure difference between a blow side and a suction side of the fan.

In addition, the air conditioning equipment according to this invention is characterized in that the blow side and the suction side of the fan is separated by a solid wall, and the plurality of small holes is provided on the solid wall.

In addition, the air conditioning equipment according to this invention is characterized in that the air conditioning equipment is a ceiling cassette type air conditioner, and the plurality of small holes is provided on a decorative panel.

In addition, the air conditioning equipment according to this invention is characterized in that the air conditioning equipment is a ceiling cassette type air conditioner, and the plurality of small holes is provided on a guide of the fan.

In addition, the air conditioning equipment according to this invention is characterized by including a first air duct in which the fan and the heat exchanger are installed; a plurality of small holes provided on at least one of the wall of any position on the blow side of the fan and a wall of any position on the suction side of the fan; and a second air duct linking one of the plurality of small holes and another of the plurality of small holes or linking the plurality of small holes and an opposite side to the suction side or the blow side of the fan on which the plurality of small holes is provided.

In addition, the air conditioning equipment according to this invention is characterized by including a first air duct in which the fan and the heat exchanger are installed; a large number of small holes provided on one of the wall of any position of the blow side of the fan and a wall of any position of the suction side of the fan; a small number of big diameter holes provided on the other of the wall of the any position on the blow side of the fan and the wall of the any position on the suction side of the fan; and a second air duct linking the large number of small holes and the small number of big diameter holes.

In addition, the air conditioning equipment according to this invention is characterized by including a plurality of small ducts installed on the blow side of the fan, the plurality of small ducts including the large number of small holes.

In addition, the air conditioning equipment according to this invention is characterized in that the plurality of small holes or the large number of small holes are provided in any position near the fan.

In addition, the air conditioning equipment according to this invention is characterized in that the second air duct is installed outside the first air duct.

In addition, the air conditioning equipment according to this invention is characterized in that the second air duct is installed inside the first air duct.

In addition, the air conditioning equipment according to this invention is characterized in that the air conditioning equipment is an air conditioning outdoor unit, the air conditioning outdoor unit includes a compressor in a housing, and an acoustic wave from the compressor propagates through the air duct.

In addition, the air conditioning equipment according to this invention is characterized in that a diameter of each of the small holes is up to 10 mm.

In addition, the air conditioning equipment according to this invention is characterized in that an open area ratio of the small holes is up to 10% where the open area ratio is a ratio of a total cross-sectional area of the small holes to a cross-sectional area of the wall of the air duct.

Fan equipment according to this invention is characterized by including, a fan blade that fans air; an air duct in which the fan blade is installed and through which an acoustic wave propagates; and a plurality of small holes that blows a jet to the air duct and sucking a jet from the air duct according to a pressure difference between a blow side and a suction side of the fan blade.

In addition, the fan equipment according to this invention is characterized by a first air duct in which the fan blade is installed; a plurality of small holes provided on at least one of the wall of any position on the blow side of the fan blade and a wall of any position on the suction side of the fan blade; and a second air duct linking one of the plurality of small holes and another of the plurality of small holes or linking the plurality of small holes and an opposite side to the suction side or the blow side of the fan blade on which the plurality of small holes is provided.

In addition, the fan equipment according to this invention is characterized by a first air duct in which the fan blade is installed; a large number of small holes provided on one of the wall of any position of the blow side of the fan blade and a wall of any position of the suction side of the fan blade; a small number of big diameter holes provided on the other of the wall of the any position on the blow side of the fan blade and the wall of the any position on the suction side of the fan blade; and a second air duct linking the large number of small holes and the small number of big diameter holes.

In addition, the fan equipment according to this invention is characterized in that the small holes are provided in a position near the fan blade.

In addition, the fan equipment according to this invention is characterized in that the second air duct is installed outside the first air duct.

In addition, the fan equipment according to this invention is characterized in that the second air duct is installed inside the first air duct.

In addition, the fan equipment according to this invention is characterized by including a fan blade that fans air; an air duct in which the fan blade is installed and a distance between a blow side of the fan blade and an exit of the air duct is substantially long; and a plurality of small holes provided on a wall near the blow side of the fan blade.

In addition, the fan equipment according to this invention is characterized by including a fan blade that fans air; an air duct in which the fan blade is installed and a distance between a suction side of the fan blade and an entrance of the air duct is substantially long; and a plurality of small holes provided on a wall near the suction side of the fan blade.

In addition, the fan equipment according to this invention is characterized by a fan blade that fans air: an air duct in which the fan blade is installed and through which an acoustic wave propagates; and a flow-channel separator installed on at least one of a blow side and a suction side of the fan blade, the flow-channel separator including a plurality of small holes, and the flow-channel separator formed in contact with the air duct on an upstream side and formed so that air blows through a narrow flow channel on a downstream side.

In addition, the fan equipment according to this invention is characterized by including a fan blade that fans air: an air duct in which the fan blade is installed and through which an acoustic wave propagates; and a flow-channel separator installed on at least one of a blow side and a suction side of the fan blade, the flow-channel separator including a plurality of small holes, and formed in contact with the air duct on an downstream side and open on an upstream side.

In addition, the fan equipment according to this invention is characterized in that a diameter of each of the small holes is up to 10 mm.

In addition, the fan equipment according to this invention is characterized in that an open area ratio of the small holes is up to 10% where the open area ratio is a ratio of a total cross-sectional area of the small holes to a cross-sectional area of the wall of the air duct.

A noise reduction method of equipment according to this invention is used in equipment in which a fan that funs air to an air duct is installed. The noise reduction method is characterized by including blowing a jet to the air duct through a plurality of small holes according to a pressure difference that is one of between a blow side and a suction side of the fan and between the blow side or the suction side of the fan and outside the air duct; and sucking in a jet from the air duct according to the pressure difference.

Pressure pulsation reduction equipment of refrigeration cycle equipment according to this invention is characterized by including a refrigeration cycle including a compressor; and a pressure pulsation reducer, which is installed on at lease one of a high pressure side and a low pressure side of the refrigeration cycle, the pressure pulsation reducer including a flow-channel separator with a plurality of small holes, and the flow-channel separator formed open on one end and in contact with a flow-channel wall on the other end.

In addition, the pressure pulsation reduction equipment of refrigeration cycle equipment according to this invention is characterized by including a pressure pulsation reducer, which is installed on at lease one of a discharge side and a suction side of the compressor, the pressure pulsation reducer including a flow-channel separator with a plurality of small holes, and the flow-channel separator formed open on one end and in contact with a flow-channel wall on the other end.

In addition, the pressure pulsation reduction equipment of refrigeration cycle equipment according to this invention is characterized by including a pressure pulsation reducer, which is installed in an oil separator that is incorporated with the compressor, the pressure pulsation reducer including a flow-channel separator with a plurality of small holes, and the flow-channel separator formed open on one end and in contact with the oil separator on the other end.

In addition, the pressure pulsation reduction equipment of refrigeration cycle equipment according to this invention is characterized by including a refrigeration cycle including a compressor; and a pressure pulsation reducer including a plurality of small holes provided on pipeline walls on a discharge side and a suction side of the compressor, the plurality of small holes on the discharged side of the compressor and the plurality of small holes on the suction side of the compressor linked by a connection pipe.

In addition, the pressure pulsation reduction equipment of refrigeration cycle equipment according to this invention is characterized in that a diameter of each small hole of the plurality of small holes is up to 10 mm.

In addition, the pressure pulsation reduction equipment of refrigeration cycle equipment according to this invention is characterized in that an open area ratio of the plurality of small holes is up to 10% where the open area ratio is a ratio of a total cross-sectional area of the plurality of small holes to a cross-sectional area of the flow-channel wall.

Pressure pulsation reduction equipment of pump equipment according to this invention is characterized by including a pressure pulsation reducer, which is installed on at lease one of a discharge side and a suction side of the pump equipment, the pressure pulsation reducer including a flow-channel separator with a plurality of small holes in a flow channel of a medium, and the flow-channel separator formed open on one end and in contact with a flow-channel wall on the other end.

In addition, the pressure pulsation reduction equipment of pump equipment according to this invention is characterized by including a pressure pulsation reducer including a plurality of small holes provided on pipeline walls on a discharge side and a suction side of the pump equipment, the plurality of small holes on the discharge side of the pump equipment and the plurality of small holes on the suction side of the pump equipment linked by a connection pipe.

In addition, the pressure pulsation reduction equipment of pump equipment according to this invention is characterized in that a diameter of each of the small holes is up to 10 mm.

In addition, the pressure pulsation reduction equipment of pump equipment according to this invention is characterized in that an open area ratio of the plurality of small holes is up to 10% where the open area ratio is a ratio of a total cross-sectional area of the plurality of small holes to a cross-sectional area of the flow-flow-channel wall.

A pressure pulsation reduction method of equipment according to this invention is used in equipment in which one of a compressor and pump equipment discharging a medium to a medium flow channel is installed. The pressure pulsation reduction method is characterized by including blowing a jet to the medium flow channel through a plurality of small holes according to one of a pressure difference between a discharge side and a suction side of the one of a compressor and pump equipment and a pressure difference that occurs in the medium flow channel of the one of the compressor and the pump equipment; and sucking in a jet from the medium flow channel according to the one of the pressure differences.

BEST MODE FOR CARRYING OUT THE INVENTION

Embodiment 1

Figure 1:
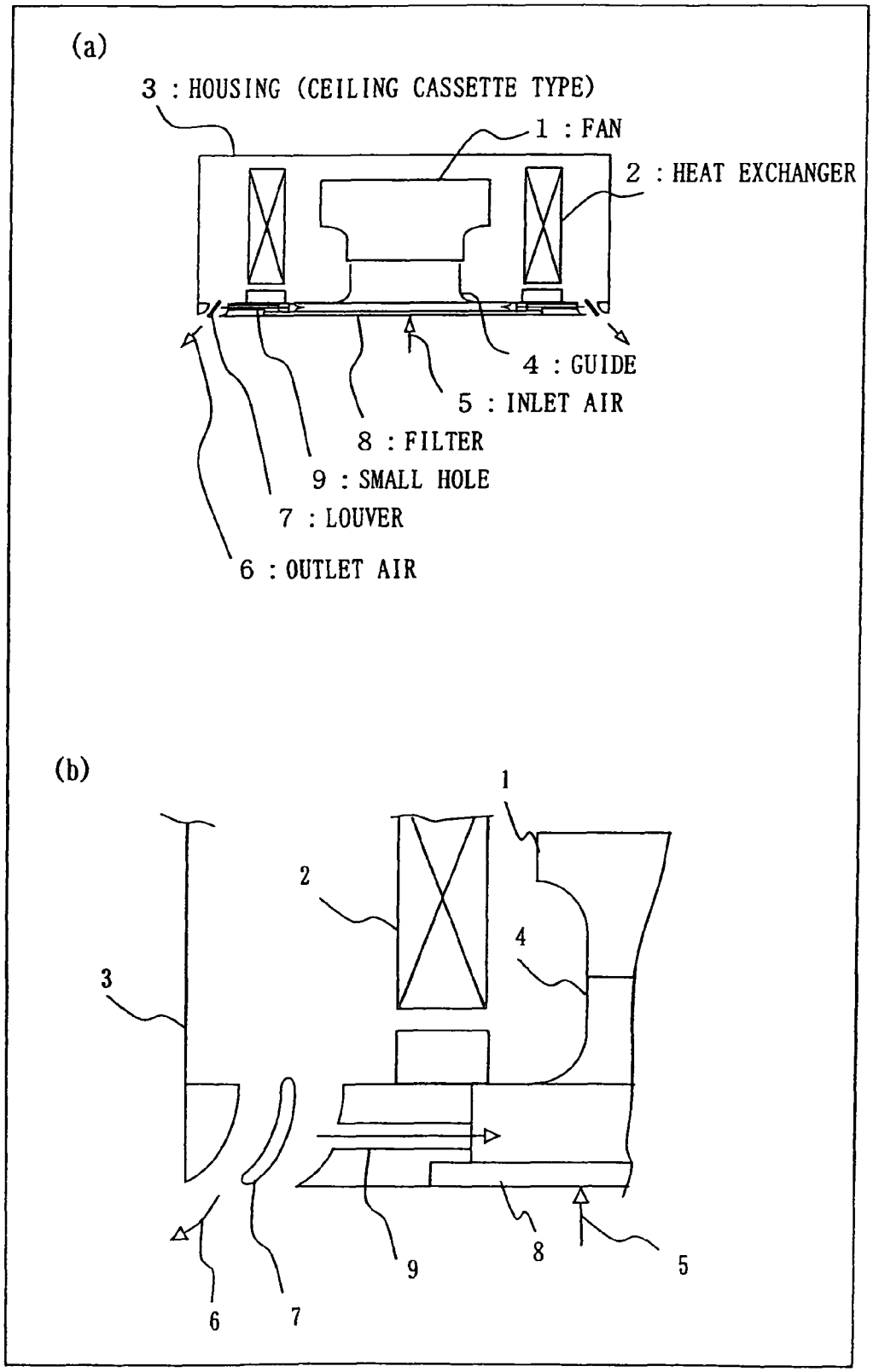
FIG. 1 is a block diagram of air conditioning equipment illustrating a noise reduction method according to a first embodiment.

FIG. 1 is a diagram of a first embodiment. FIG. 1(*a*) is a block diagram of air conditioning equipment illustrating a noise reduction method. FIG. 1(*b*) is an enlarged diagram showing a vicinity of small holes. The air conditioning equipment shown in the figures is a ceiling cassette type indoor unit. A housing 3 contains a fan 1 and a heat exchanger 2. Inlet air 5 that is sucked in through an air inlet passes through a filter 8 and a guide 4 towards a suction side of the fan 1. Outlet air 6 is blown out from the fan 1 in various directions by a louver 7. Small holes 9 are formed on a decorative panel so as to link the air outlet and the air inlet.

When the thus configured air conditioning equipment starts operating, the inlet air 5 is sucked in through the air inlet to the housing 3 by the induction effect of the fan 1 and then supplied to the heat exchanger 2 through the filter 8. Then, the inlet air 5 is heated in a heating operation and cooled in a cooling operation in the heat exchanger 2, and then blown out from the housing 3 to the room as the outlet air 6.

Now that the fan 1 is working on funning air from the suction side to the blow side, air is compressed on the blow side of the fan 1 and therefore the air pressure is higher than that on the suction side. In other words, there is a pressure difference between air on the suction side and air on the blow side of the fan. This pressure difference increases when the rotational speed of the fan increases, and drops when the rotational speed drops.

On the other hand, different noises by different generation mechanisms occur such as motor sound produced by a motor to drive the fan 1; hissing sound produced by rotary vanes of the fan 1 cutting the air and interference sound produced by airflow generated by one vane interfering another vane of the fan 1; scraping sound of airflow produced by passage of air through the air duct and the heat exchanger 2, cylinder group generating sound produced by a group of pipelines and edge tone produced by projections; and jet flow sound produced by air blowing from the air outlet. Those noises are different in center frequency or sonic type (continuous sound, intermittent sound, sound of a broad frequency band, sound of a narrow frequency band, etc.) for their different generation mechanisms.

Now, it is a common practice to reduce noise by reviewing the plan for the respective members of the air duct of air conditioning equipment. More particularly, a projection that can cause the edge tone is removed from an air duct. Alternatively, the vane configuration of a fan is reviewed to reduce noise such as the hissing sound and interference sound and so forth.

In fact, there is no way to minimize original sound to infinity. Therefore, a sound absorption material or a resonator is used to further reduce noise. However, with a method using a sound absorption material, very effective sound absorption can only be expected mainly in the high frequency range. With a method using a resonator, effective noise reduction can only be expected in the narrow frequency range. In addition, should the resonant frequency be set at a frequency that is desirable, quite a large space (back layer) is needed.

It should be noted that noise is a group of acoustic waves at various frequencies. Acoustic waves are compressional waves with the pressure distribution (density) of media, such as air. Therefore, in a field which acoustic waves propagate through, the pressure of a medium fluctuates periodically to the plus or minus side of a steady state pressure. This pressure fluctuation range is called acoustic pressure indicating the magnitude of sound.

On the other hand, recent studies have shown that a jet flow of air that is blown out through small holes at some speed allows for noise reduction. This noise reduction mechanism includes various theories, and a full elucidation of the mechanism has not been reached yet. "Attenuation of sound in a low Mach number nozzle flow" written by M. S. Howe, and published on pages 209-229 of "Journal of Fluid Mechanics" issued in 1979 describes that part of jet energy is used as energy for vortex generation. A description will be given below with reference to FIG. 2 to FIG. 4 of a noise reduction mechanism by vortices based on this phenomenon.

Figure 2:
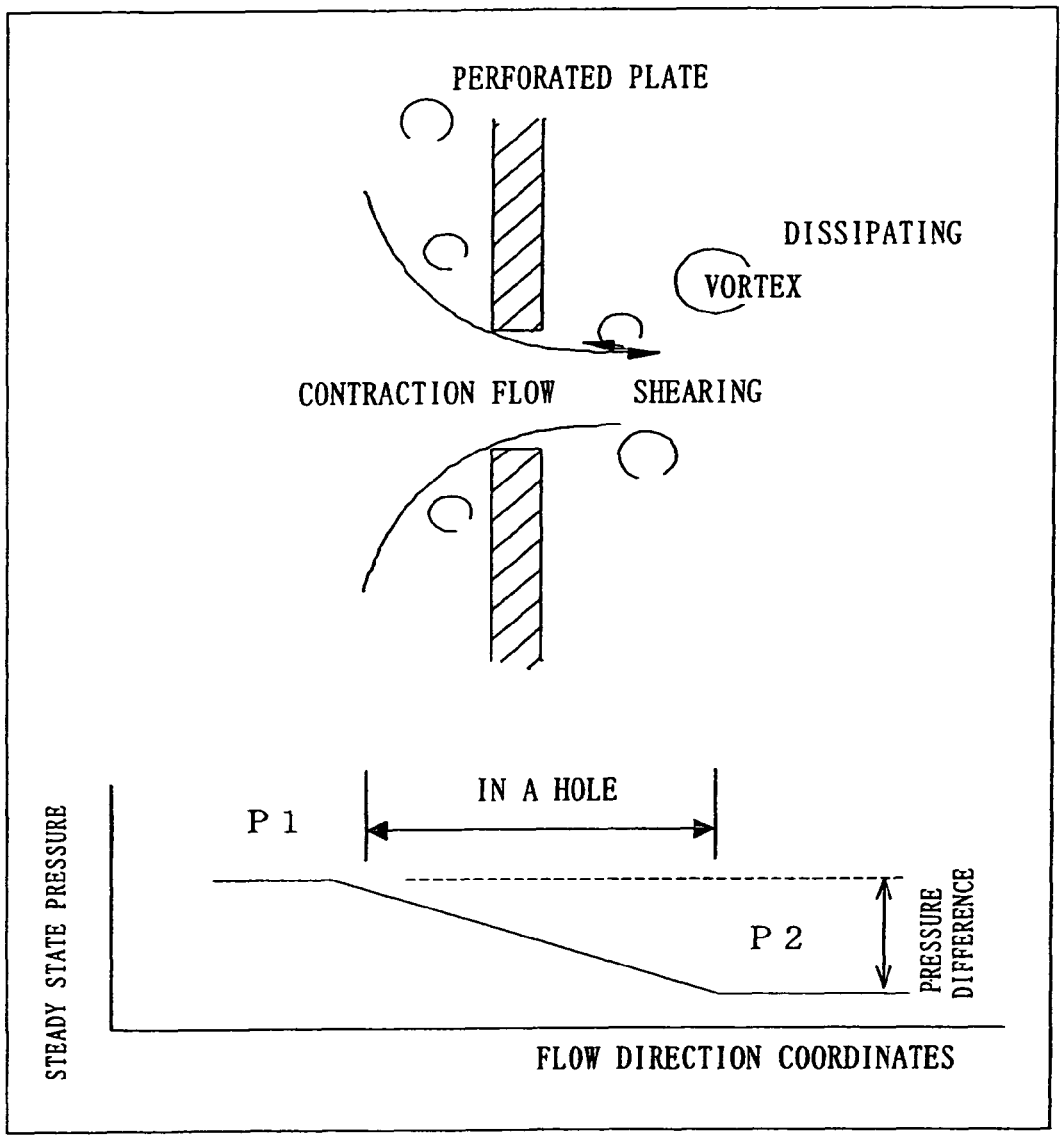
FIG. 2 is a diagram illustrating a principle of noise reduction using small holes according to the first embodiment.

A pressure difference between both ends of a perforated plate forms a contraction flow through the holes according to the pressure difference (FIG. 2). As a result, according to the Howe's paper, on the downstream side of the contraction flow, shear effect in the surrounding air converts part of the energy of the contraction flow into vortex energy, thereby generating a vortex. The bigger the deference between the speed of the contraction flow and the speed of the surrounding air, the stronger the shear effect. A generated vortex is swept away from the holes by the contraction flow. Then, in the transfer process, it is converted into thermal energy, that is, temperature rise of the surrounding air, and pressure energy, that is, acoustic release to the surrounding air, when influenced by shearing and friction in the surrounding air. Finally, the vortex dissipates. In other words, near the contraction flow, a series of this vortex generation and dissipation are repeated continuously. This creates space of pulsation including contraction flows and vortices around the holes. The dimension of a vortex generated by the contraction flow at the holes depends upon a diameter d of the hole. A frequency f of sound generated by a vortex is expressed as:

$$f \propto U/d$$

where U denotes the speed of the contraction flow, so that the generation period of a vortex is 1/f.

Now, it is assumed that an acoustic wave whose wavelength λ is considerably longer than the diameter of the hole (λ>>d) enters near the contraction flow. As referred to earlier, in the field which acoustic waves propagate through, medium pressure fluctuates periodically to the plus or minus side of the steady state pressure for the acoustic pressure. Thus, if the high or low pressure components of this acoustic wave enters near the contraction flow, the steady state pressure rises on the upstream side and drops on the downstream side of the holes at the instant of vortex generation as shown in FIG. 3.

Figure 3:
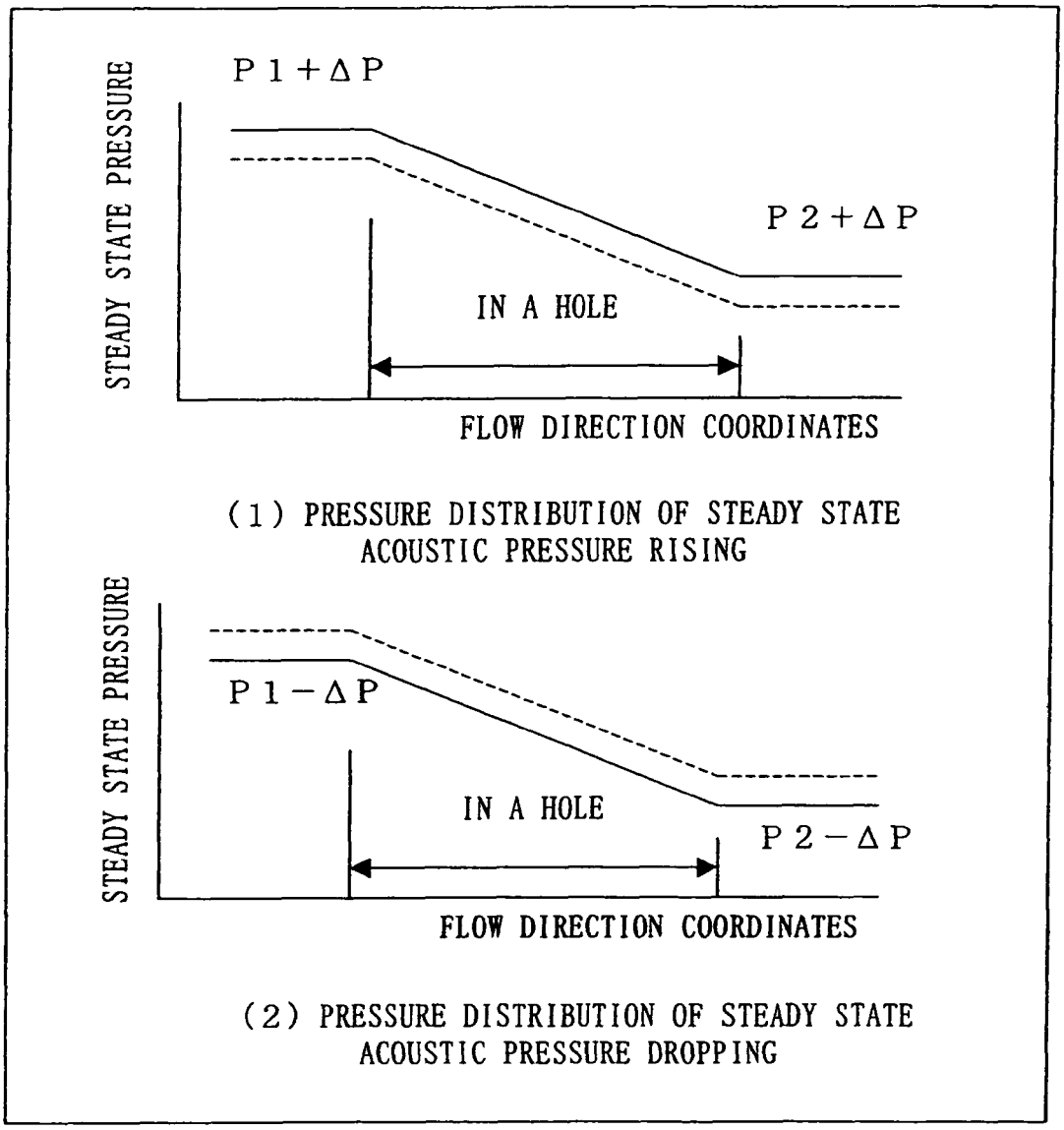
FIG. 3 is another diagram illustrating the principle of noise reduction using small holes according to the first embodiment.

In the case where the high pressure components of the acoustic wave enters, so that the steady state acoustic pressure rises (FIG. 3 (1)), the amount of pressure fluctuation is the same on both sides of the holes, and the pressure difference between before and after the holes is fixed. However, when pressure rises, then a steady state density p rises accordingly. The steady state speed U of the contraction flow is expressed from Bernoulli's theorem as:

$$U \propto \sqrt{\frac{P1 - P2}{\rho}}$$

where P1 and P2 denote pressures on both sides of the holes. When the steady state density p rises, then the steady state speed U drops. Thus, when the steady state acoustic pressure rises, that is, pressure fluctuation ΔP>0, the steady state speed drops, that is, speed fluctuation ΔU<0.

To the contrary, in the case where the low pressure components of acoustic pressure enters, so that the steady state acoustic pressure drops (FIG. 3 (2)), the pressure difference is constant and the steady state density drops likewise. Therefore, the speed of the contraction flow increases. Thus, when the acoustic pressure drops, that is, pressure fluctuation ΔP<0, the steady state speed increases, that is, speed fluctuation ΔU>0.

Mechanical energy E in the space near the holes is obtained by one cycle of integration of the product of pressure fluctuation ΔP and speed fluctuation ΔU from Newton's Second Law. This is expressed as:

$$E = \int (\Delta P \cdot \Delta U) \cdot dt$$

Figure 4:
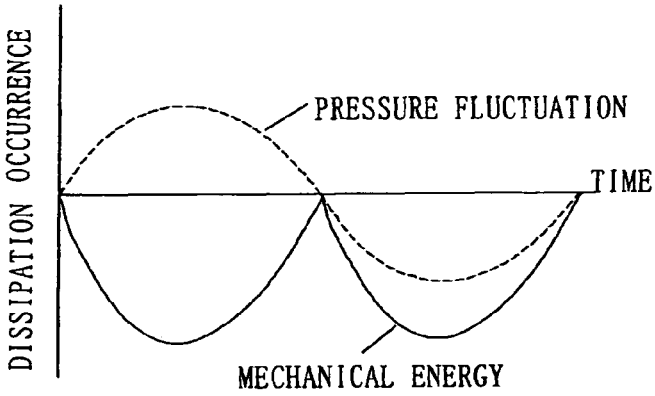
FIG. 4 is another diagram illustrating the principle of noise reduction using small holes according to the first embodiment.

Therefore, as referred to earlier, when ΔP>0, then ΔU<0, and when ΔP<0, then ΔU>0. Thus, the mechanical energy E is always negative (FIG. 4). Negative mechanical energy means that the sound energy dissipates and the acoustic energy drops or the noise drops.

Now, the noise reduction effect based on this principle is premised on that the pressure fluctuation cycle is considerably slower than the speed of vortex generation by the contraction flow. Then, the effect is especially high in the low frequency range.

Figure 5:
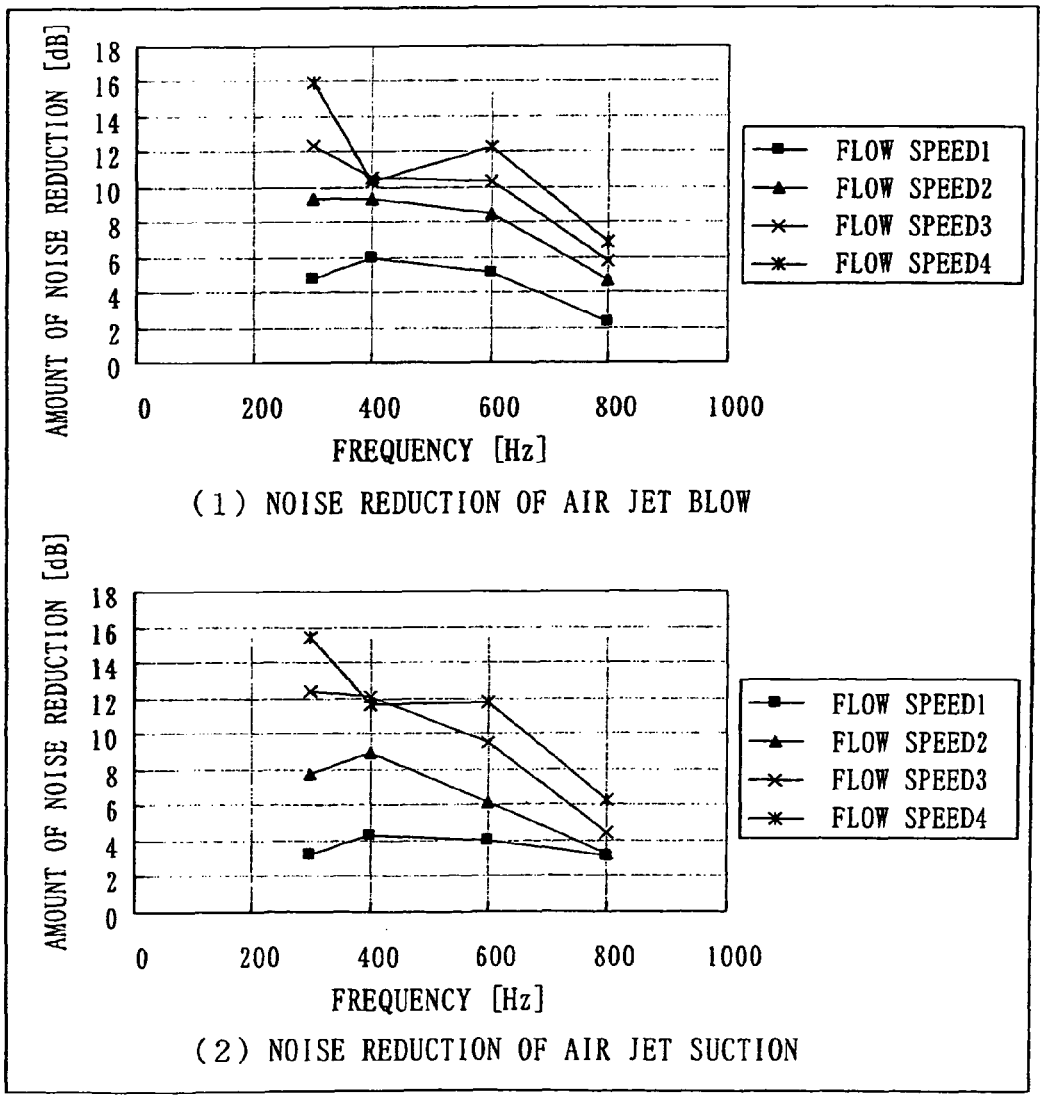
FIG. 5 is a diagram illustrating an experimental result of noise reduction based on the noise reduction method of air conditioning equipment according to the fist embodiment.

FIG. 5 shows experimental results that confirmed the effect of the noise reduction method of the present invention. More specifically, the figure shows a measured amount of noise reduction in the case of no jet flow existing under the following condition: the perforated plate is installed in a flow channel through which noise propagates; a jet flow is supplied to the flow channel through the holes of the perforated plate; and the noise frequency and the jet speed are fluctuated. With referring to FIG. 5, the horizontal axis shows the noise frequency and the vertical axis shows the amount of noise reduction. FIG. 5 (1) shows the experimental result of the case where the jet flow is blown out to a field where acoustic waves propagate. FIG. 5 (2) shows the experimental result of the case where the jet flow is sucked in. It should be noted that the speed of the jet flow shown in the figure has the following relation:

Flow speed 1<Flow speed 2<Flow speed 3<Flow speed 4.

This shows that the noise reduction effect is sufficient in the low frequency range of 1 kHz or below. It also shows that the higher the jet speed, the stronger the noise reduction effect. It also shows that the same noise reduction effects can be achieved if a jet is blown out to a fluid through which acoustic waves propagate, or if a fluid through which acoustic waves propagate is sucked from outside.

It is also shown from other experimental results that a smaller diameter of the hole is desirable.

Therefore, like the air conditioning equipment shown in FIG. 1, when a position on the blow side and a position on the suction side of the fan 1 stand side by side over a solid wall, the small hole 9 may be provided on part of the solid wall. This allows, from the Bernoulli's theorem referred to earlier, a natural airflow from the blow side to the suction side of the fan 1 through the small hole 9 in accordance with the pressure difference. In this case, the blow side of the fan 1 becomes the suction side of the air that is sucked in through the small hole 9, and the suction side of the fan 1 becomes the blow side of air that is blown through the small hole 9. Therefore, as referred to earlier, the noise reduction effect can be achieved on both sides of the fan.

Figure 6:
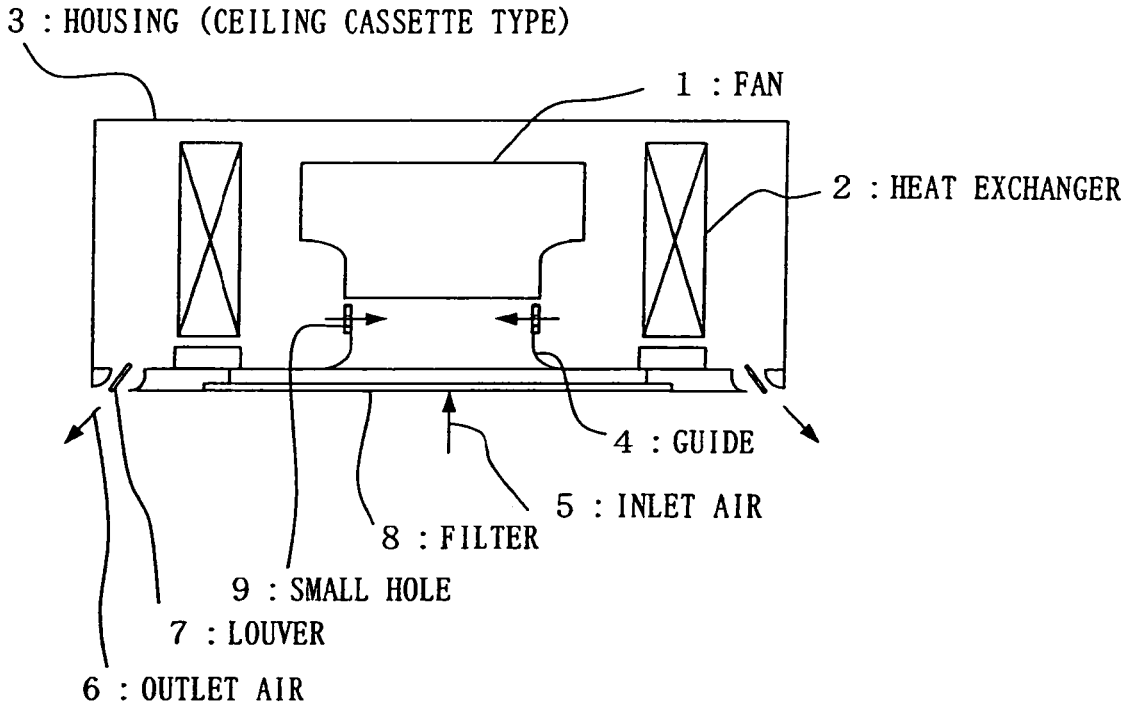
FIG. 6 is another block diagram of air conditioning equipment illustrating the noise reduction method according to the first embodiment.

With reference to this noise reduction method, the small hole 9 can be provided on any wall that divides a position on the blow side of the fan 1 from a position on the suction side of the fan 1 in the duct. The same effect can be achieved also in the case where the small holes 9 are provided on an alternative solid wall that divides the blow side from the suction side of the fan 1, such as the guide 4, for example, like air conditioning equipment shown in FIG. 6.

With further reference to this noise reduction method, the noise reduction effect can be achieved with any open area ratio of the small hole (that is defined as the total open area of the small hole for a given area of the duct wall). Theoretically, however, to achieve the same noise reduction effect, if the open area ratio of the small hole is high, then the speed of air through the hole must be high. Practically, therefore, a low open area ratio is desirable when considering the feasible pressure difference of actual equipment. In addition, if the open area ratio of the small hole is high, then the amount of bypassing air becomes large which causes a substantial loss. This also shows that a low open area ratio is desirable. Consequently, the most desirable open area ratio of the small hole is as small as 1% or 2%. For practical purposes, however, an open area ratio up to 10% is considered acceptable for the small hole.

With further reference to this noise reduction method, any size can be used for the diameter of the small hole. However, available pressure for the fan is limited. For all of these reasons, therefore, it is desirable to keep the same open area of the small hole for practical purposes. If the diameter of the small hole is large, however, the number of the small holes must be reduced to keep the same open area ratio of the small hole. Because a vortex occurs at the end of the small hole, and a jet angle formed by a jet blow is constant, if the diameter of the small hole is large, then the effective range of the jet flow gets narrow. This lowers the effect on noise reduction. Thus, the most desirable size of the diameter of the small hole is as small as 1 mm or 2 mm. For practical purposes, however, a diameter up to 10 mm is considered acceptable for the small hole.

Embodiment 2

Figure 7:
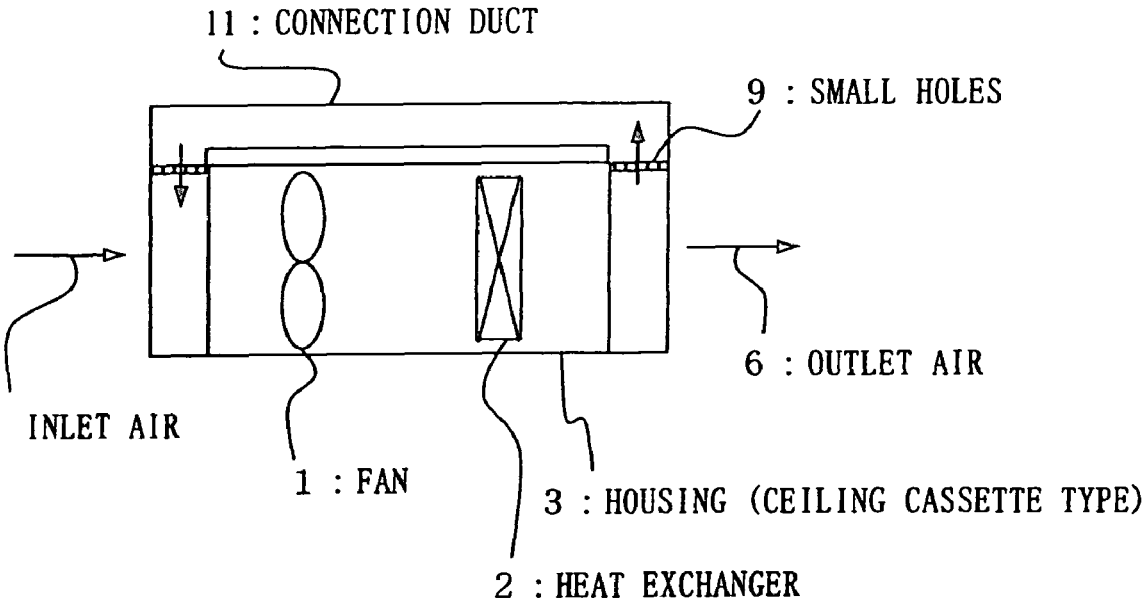
FIG. 7 is a block diagram of air conditioning equipment illustrating a noise reduction method according to a second embodiment.

FIG. 7 is a block diagram of air conditioning equipment illustrating a noise reduction method according to a second embodiment. With reference to the figure, the air conditioning equipment is a ceiling built-in type indoor unit. A housing 3, a first air duct, contains a fan 1 and a heat exchanger 2. Inlet air 5 is sucked in through an air inlet and outlet air 6 is blown out through an air outlet. A connection duct 11, a second air duct, is installed outside the housing 3. The connection duct 11 has small holes 9 on the suction side and the blow side of the fan 1.

When the thus configured air conditioning equipment starts operating, the inlet air 5 sucked in through the air inlet into the housing 3 by the induction effect of the fan 1 is supplied to the heat exchanger 2. The air is then heated in a heating operation and cooled in a cooling operation in the heat exchanger 2, and then blown out from the housing into a room as the outlet air 6.

It should be noted that the pressure difference between the blow side and the suction side of the fan 1, the relation between the fan rotational speed and pressure, the types of noise produced in the housing, the relation between the acoustic wave and the compressional wave, the nature of the jet flow, and so forth have already been discussed in the first embodiment, and therefore the discussion will not be repeated here.

The air conditioning equipment shown in FIG. 7 is different from that shown in FIG. 1 of the first embodiment in that a position on the blow side and a position on the suction side of the fan 1 do not stand side by side over a solid wall. Instead, as shown in FIG. 7, porous plates with the small holes 9 are installed anywhere on the blow side wall and the suction side wall of the fan 1 and connected by means of the connection duct 11.

This allows air to flow from the blow side towards the suction side of the fan 1 through the connection duct 11 by the pressure difference created by the fan 1. Consequently, the mechanism discussed in the first embodiment allows for reducing noise that propagates through the air both to the air inlet side to the small holes 9 and the air outlet side from the small holes 9, that is, to the blow side and the suction side of the fan 1, respectively.

Figure 8:
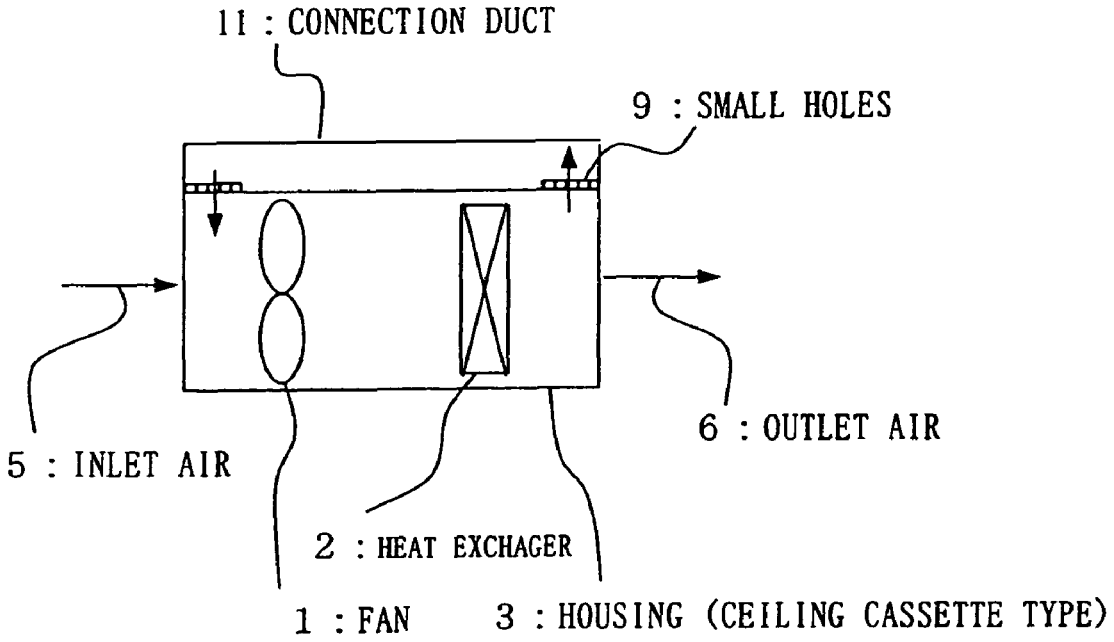
FIG. 8 is another block diagram of air conditioning equipment illustrating the noise reduction method according to the second embodiment.
Figure 9:
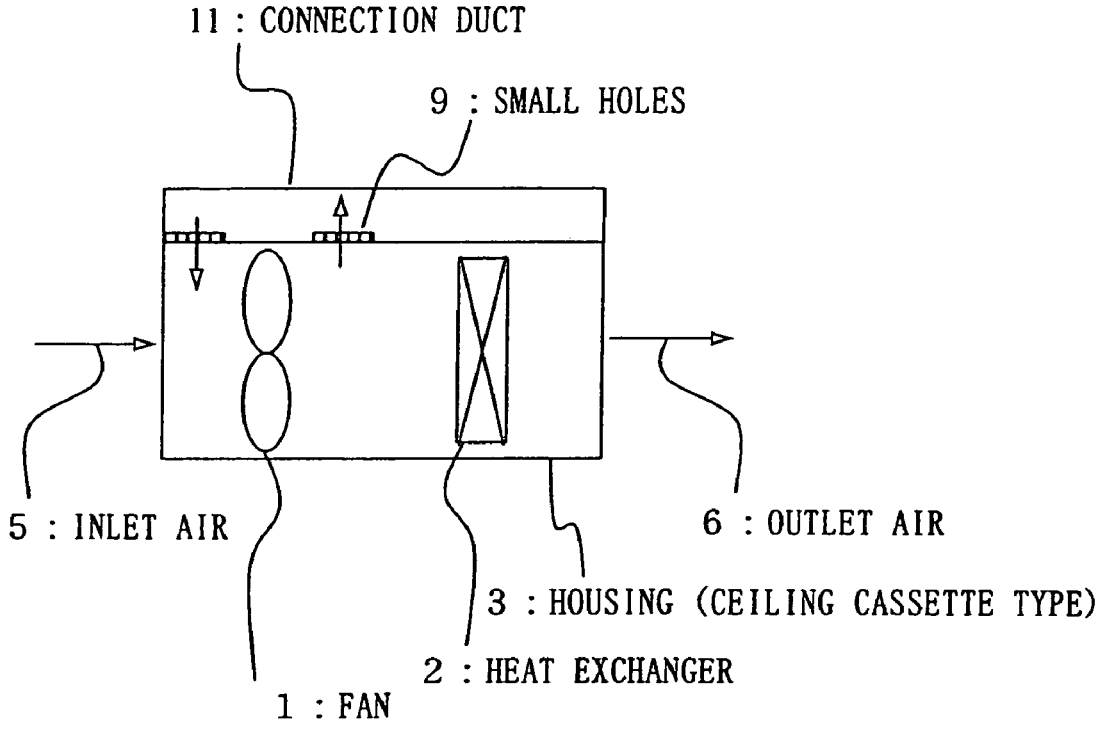
FIG. 9 is another block diagram of air conditioning equipment illustrating the noise reduction method according to the second embodiment.

With further reference to this noise reduction method, the small holes 9 and the connection duct 11 can be provided anywhere on the blow duct side and the suction duct side of the fan 1. Accordingly, they may be installed outside the existing housing 3 as shown in FIG. 7, or otherwise installed inside the existing housing 3 as shown in FIG. 8 and FIG. 9. In these cases, because the small holes 9 and the connection duct 11 are close to the fan, the pressure difference is large, and therefore the noise reduction effect is high (highest with a FIG. 9 configuration). In addition, the small holes 9 and the connection duct 11 may be built in the housing 3, which allows for an easy and low-cost manufacturing.

Figure 10:
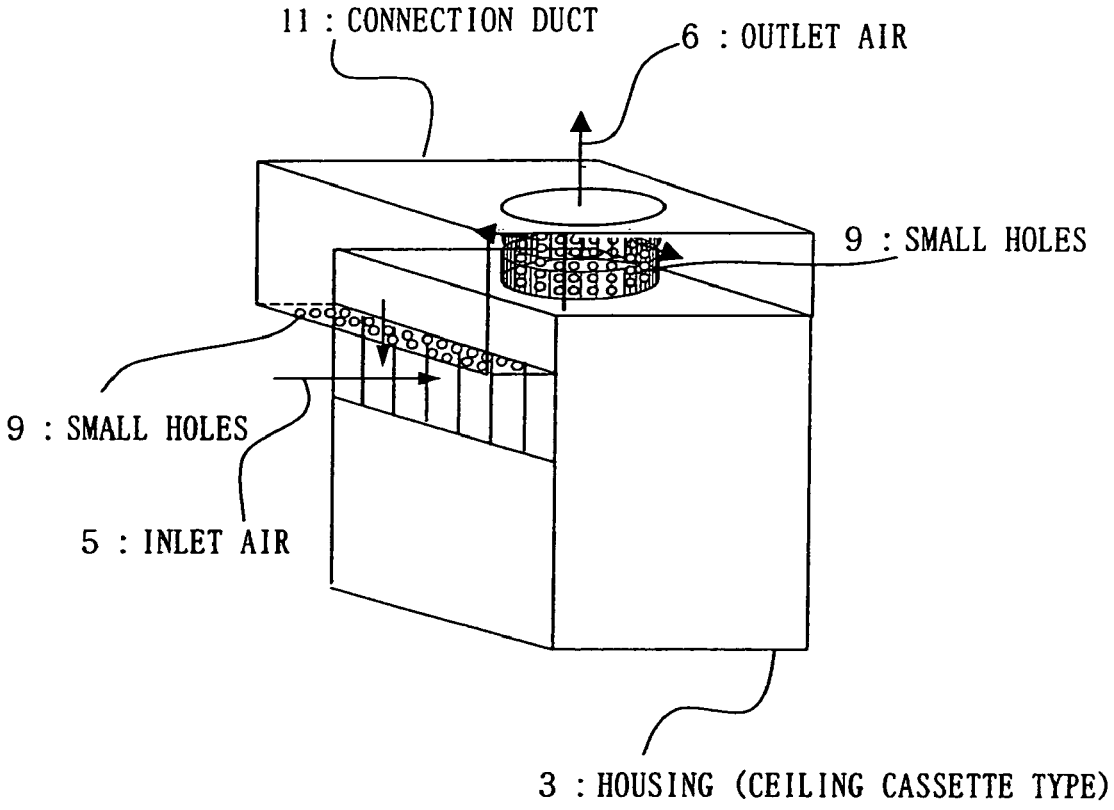
FIG. 10 is another block diagram of air conditioning equipment illustrating the noise reduction method according to the second embodiment.

It is to be noted that a description has been given here with reference to the ceiling built-in type air conditioning indoor unit as one example of the housing, which is not the only possibility. The same effect may be achieved by the case of an air conditioning outdoor unit, instead, as shown in FIG. 10. In this case, however, the housing 3 contains not only a fan but also a compressor for compressing a refrigerant, and therefore causes noise. With the noise reduction method of the present invention, however, the same noise reduction is allowed equally with the acoustic waves of the same frequency, regardless of the sound types of sound sources. This is clear from the noise reduction mechanism discussed in the first embodiment.

With further reference to this noise reduction method, the noise reduction effect can be achieved with any open area ratio of the small hole (that is defined as the total open area of the small hole for a given area of the duct wall). Theoretically, however, to achieve the same noise reduction effect, if the open area ratio of the small hole is high, then the speed of air through the hole must be high. Practically, therefore, a low open area ratio is desirable when considering the feasible pressure difference of actual equipment. In addition, if the open area ratio of the small hole is high, then the amount of bypassing air becomes large which causes a substantial loss. This also shows that a low open area ratio is desirable. Consequently, the most desirable open area ratio of the small hole is as small as 1% or 2%. For practical purposes, however, an open area ratio up to 10% is considered acceptable for the small hole.

With further reference to this noise reduction method, any size can be used for the diameter of the small hole. However, available pressure for the fan is limited. For all of these reasons, therefore, it is desirable to keep the same open area of the small hole for practical purposes. If the diameter of the small hole is large, however, the number of the small holes must be reduced to keep the same open area ratio of the small hole. Because a vortex occurs at the end of the small hole, and a jet angle formed by a jet blow is constant, if the diameter of the small hole is large, then the effective range of the jet flow gets narrow. This lowers the effect on noise reduction. Thus, the most desirable size of the diameter of the small hole is as small as 1 mm or 2 mm. For practical purposes, however, a diameter up to 10 mm is considered acceptable for the small hole.

In the foregoing description of this embodiment, the small holes 9 are provided on both ends of the connection duct 11. Alternatively, however, the small holes 9 may be provided only on either end thereof instead.

Furthermore, a description has been given here with reference to the case of circulating air by the fan 1 as an example. The same can be applied to other media: water may be circulated by a pump, and refrigerant may be circulated by a compressor, for example.

Embodiment 3

With reference to the first embodiment, the small holes 9 are provided at both ends of the connection duct 11. Alternatively, however, the small holes 9 may be provided at either end in a large number and big diameter holes at the other end in a small number.

Figure 11:
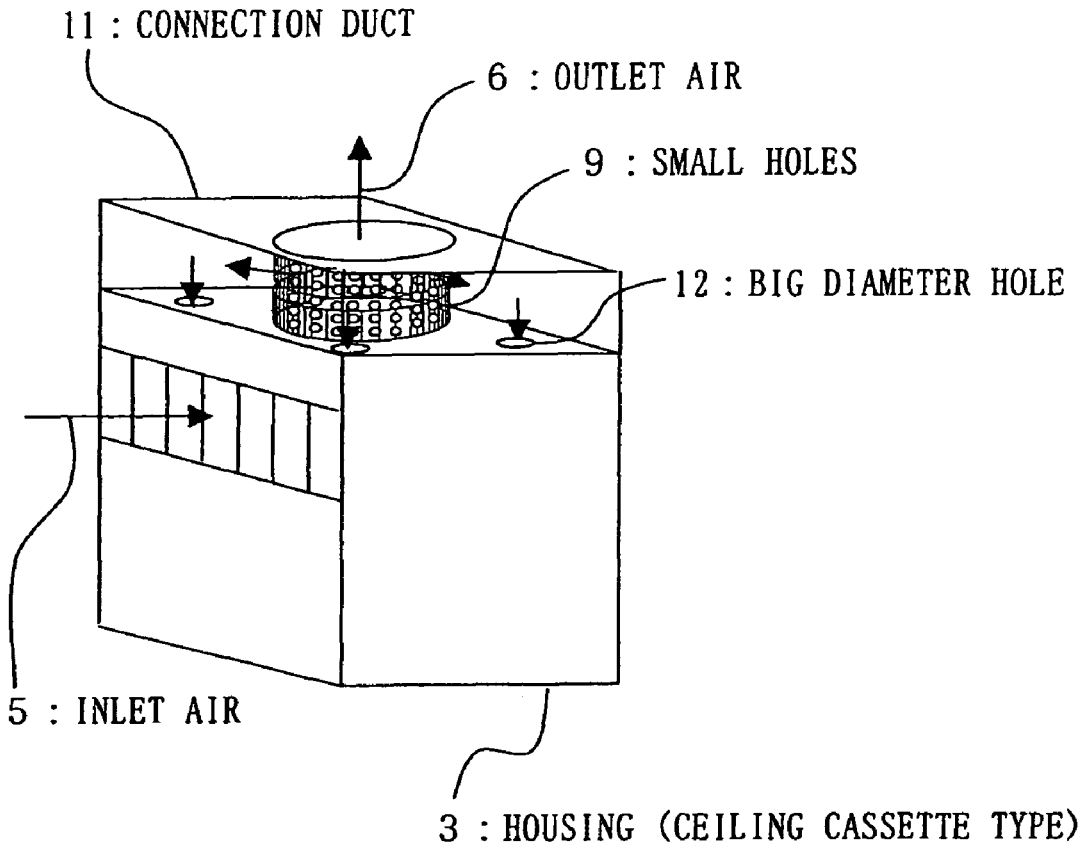
FIG. 11 is a block diagram of air conditioning equipment illustrating a noise reduction method according to a third embodiment.

FIG. 11 is a block diagram of air conditioning equipment illustrating a noise reduction method according to a third embodiment.

With reference to the figure, when an air conditioning outdoor unit starts operating, inlet air 5 that is sucked in through an air inlet into a housing 3 by the induction effect of a fan 1 is heated and cooled through a heat exchanger 2, and then blown out from the housing 3 as outlet air 6. At an air outlet, a perforated duct including a large number of small holes is installed. Around the perforated duct, a connection duct that is in contact with a top panel of the housing 3 is provided. The top panel of the housing 3 includes a small number of big diameter holes, which link to the suction side of the fan. Therefore, the outlet air 6 follows a pressure difference that is created by the fan and flows from the blow side towards the suction side of the fan through the connection duct 11. This allows reducing noise on the air outlet side with the small holes 9. Such effective noise reduction cannot be expected on the side with the big diameter holes 12. Instead, however, a lower cost configuration may be achieved compared to the case where the small holes are provided on both sides.

Embodiment 4

With reference to the third embodiment, the perforated duct including small a large number of holes is installed at the air outlet. Alternatively, however, a plurality of small perforated duds may be installed on the air outlet side.

Figure 12:
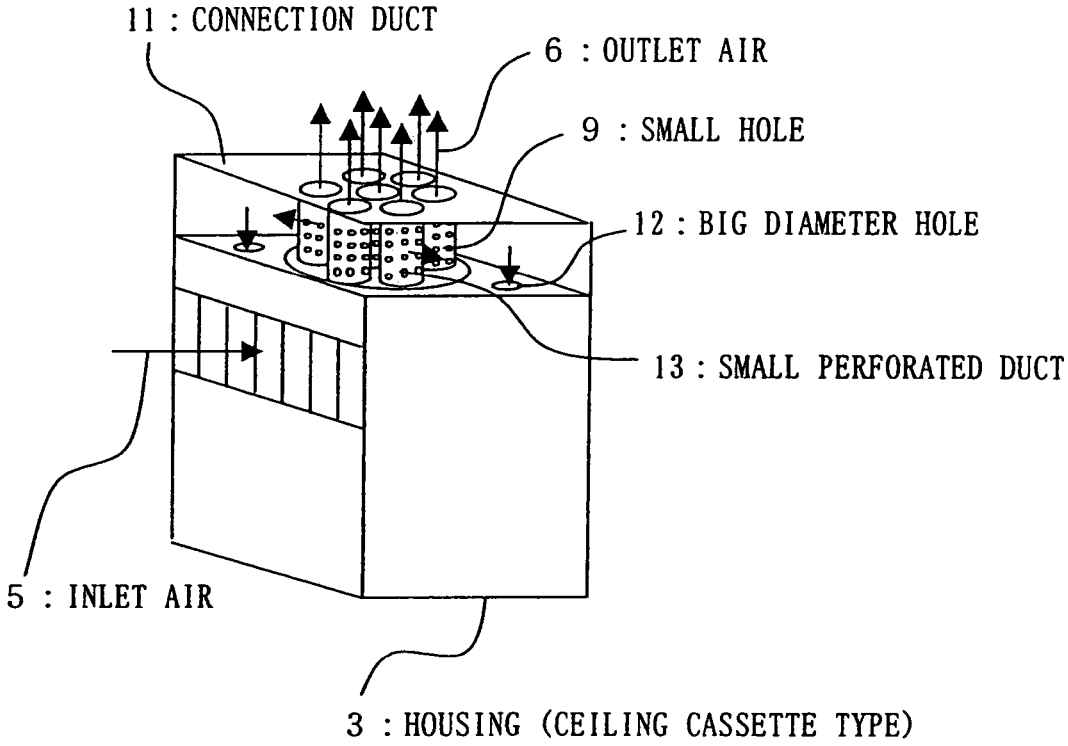
FIG. 12 is a block diagram of air conditioning equipment illustrating a noise reduction method according to a fourth embodiment.

FIG. 12 is a block diagram of air conditioning equipment illustrating a noise reduction method according to a fourth embodiment. As shown in the figure, a plurality of small perforated ducts 13 is installed on the air outlet side. The larger is a value obtained by dividing the length of the inner periphery of a fan duct by the sectional area of the duct, the higher is the noise reduction effect. Therefore, the air conditioning equipment thus configured allows for much higher noise reduction than the case of the second embodiment. In addition, the smaller is the inside diameter of the duct, the higher is the frequency range that receives the noise reduction effect. Accordingly, higher overall noise reduction effects can be achieved. On the other hand, however, the amount of air that is bypassed to the air inlet side is also increased, and therefore the diameter of a duct needs to be determined according to the system.

Embodiment 5

Figure 13:
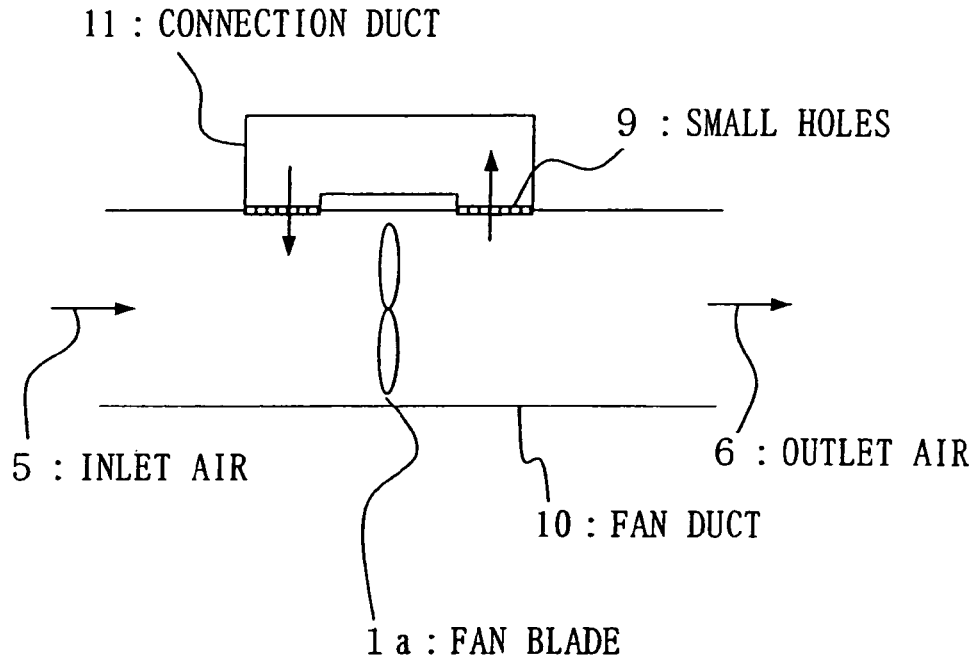
FIG. 13 is a block diagram of fan equipment illustrating a noise reduction method according to a fifth embodiment.

FIG. 13 is a block diagram of fan equipment illustrating a noise reduction method according to a fifth embodiment. A fan duct 10, a first air duct, contains a fan blade 1*a*. Inlet air 5 is sucked in towards the fan blade 1*a*, and outlet air 6 is blown out through the fan blade 1*a*. Small holes 9 are provided on the suction side wall and the blow side wall of the fan blade 1*a* in the fan duct 10, and linked to each other by means of a connection duct 11 as a second air duct.

When the thus configured fan equipment starts operating, the inlet air 5 is sucked in on one side of the fan duct by the induction effect of the fan blade 1*a*, and blown outside from the fan duct 10 as the outlet air 6.

It should be noted that the pressure difference between the blow side and the suction side of the fan 1, the relation between the fan rotational speed and pressure, the types of noise produced in the housing, the relation between the acoustic wave and the compressional wave, the nature of the jet flow, and so forth have already been discussed in the first embodiment, and therefore the discussion will not be repeated here.

The fan equipment shown in FIG. 13 differs from the one shown in FIG. 8 of the second embodiment only in that there is no heat exchanger and the air duct is the fun duct, instead of the housing. Therefore, as shown in the figure, if the small holes 9 are provided on the walls before and after the fan blade 1*a* and linked to each other by means of the connection duct 11, then air flows through the connection duct. This will allow for the same noise reduction.

Figure 14:
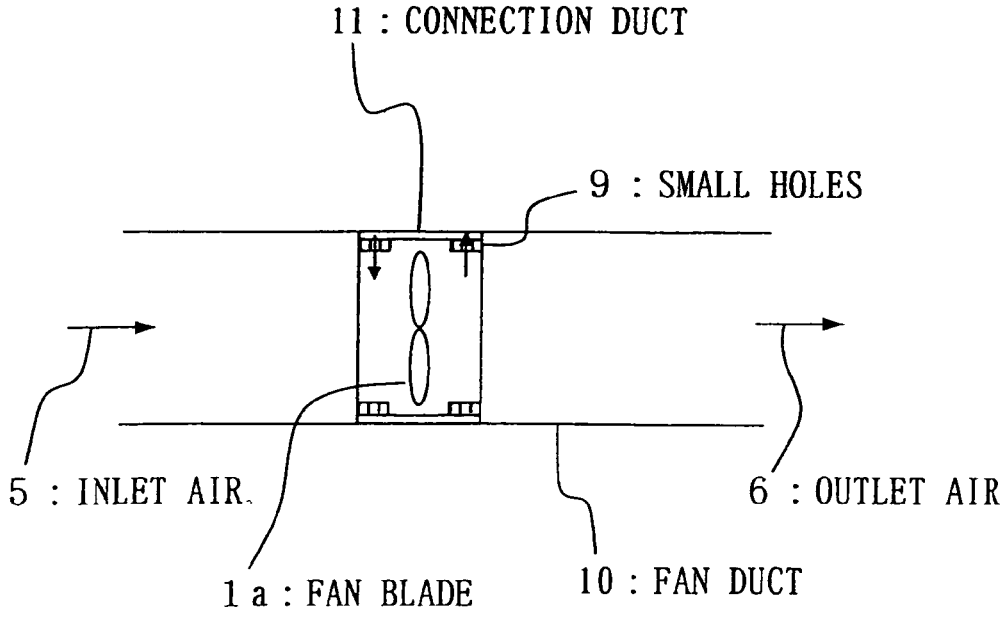
FIG. 14 is another block diagram of fan equipment illustrating the noise reduction method according to the fifth embodiment.

It should be noted that the connection duct 11 may be installed outside the fan duct 10 as shown in FIG. 13 or otherwise installed inside the fan duct 10 as shown in FIG. 14. In the case of installing the connection duct 11 outside the fan duct 10, an existing fan duct can be installed with a partial alteration by some additional work. This is suitable for the case of renewal. In the case of installing the connection duct 11 inside the fan duct 10, a fan unit incorporating the small holes 9 and the connection duct 11 can be manufactured. This allows space saving for installation together with a merit of low cost.

Figure 15:
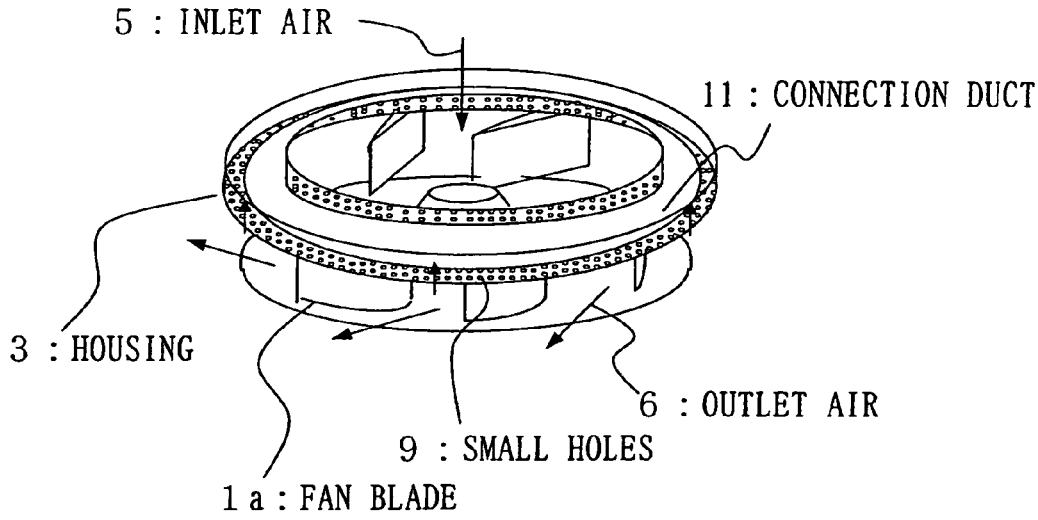
FIG. 15 is another block diagram of fan equipment illustrating the noise reduction method according to the fifth embodiment.
Figure 16:
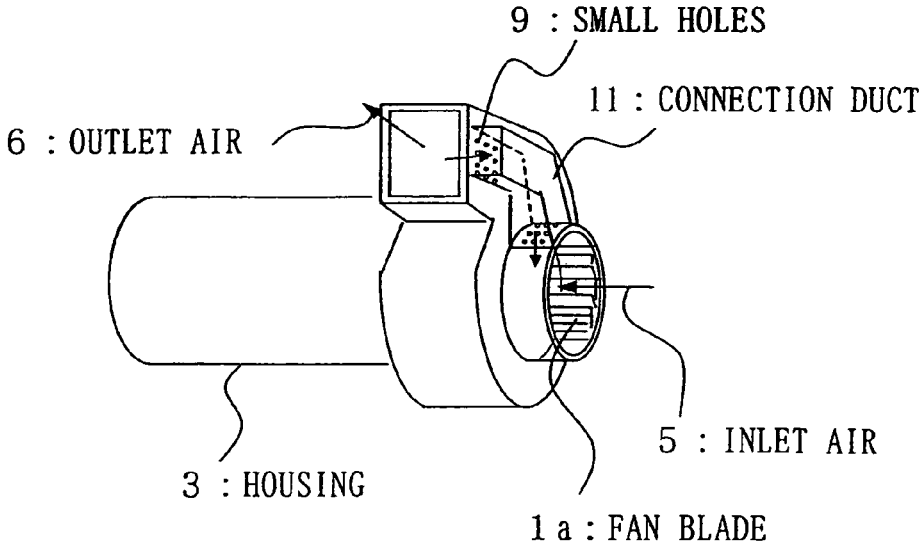
FIG. 16 is another block diagram of fan equipment illustrating the noise reduction method according to the fifth embodiment.

In addition, FIG. 13 and FIG. 14 show the fan blade 1*a* as if it is a propeller fan, which is not the only possibility. A turbo fan shown in FIG. 15 and a sirocco fan shown in FIG. 16 are also possible alternatives. If they allow installing the small holes 9 and the connection duct 11 together, the same effect can be achieved.

With further reference to this noise reduction method, the noise reduction effect can be achieved with any open area ratio of the small hole (that is defined as the total open area of the small hole for a given area of the duct wall). Theoretically, however, to achieve the same noise reduction effect, if the open area ratio of the small hole is high, then the speed of air through the hole must be high. Practically, therefore, a low open area ratio is desirable when considering the feasible pressure difference of actual equipment. In addition, if the open area ratio of the small hole is high, then the amount of bypassing air becomes large which causes a substantial loss. This also shows that a low open area ratio is desirable. Consequently, the most desirable open area ratio of the small hole is as small as 1% or 2%. For practical purposes, however, an open area ratio up to 10% is considered acceptable for the small hole.

With further reference to this noise reduction method, any size can be used for the diameter of the small hole. However, available pressure for the fan is limited. For all of these reasons, therefore, it is desirable to keep the same open area of the small hole for practical purposes. If the diameter of the small hole is large, however, the number of the small holes must be reduced to keep the same open area ratio of the small hole. Because a vortex occurs at the end of the small hole, and a jet angle formed by a jet blow is constant, if the diameter of the small hole is large, then the effective range of the jet flow gets narrow. This lowers the effect on noise reduction. Thus, the most desirable size of the diameter of the small hole is as small as 1 mm or 2 mm. For practical purposes, however, a diameter up to 10 mm is considered acceptable for the small hole.

Furthermore, a description has been given here with reference to the case of circulating air by the fan 1 as an example. The same can be applied to other media: water may be circulated by a pump, and refrigerant may be circulated by a compressor, for example.

Embodiment 6

With reference to the fifth embodiment, the small holes 9 are provided on the both ends of the connection duct 11. Alternatively, however, the small holes 9 may be provided on one end in a large number and big diameter holes may be provided on the other end in a small number. In this case as well, the pressure difference of the fan allows air to flow through the duct 11, so that noise can be reduced on the side with the small holes 9. Such an effective noise reduction cannot be expected on the side with the big diameter holes. However, noise intrusion to the room side is sufficiently banned, so that it is satisfactory effective with duct air conditioning for funning air to a room, for example. With this configuration, a lower cost structure may be achieved compared to the case where the small holes are provided on both sides.

Embodiment 7

With reference to the fifth embodiment, the fan blade 1*a* is installed in the fan duct 10 as the first air duct. The first air duct cannot always be the solid wall. From the same principle, effective noise reduction may be achieved with any system in which a fluid flows near a solid body and through which noise propagates. For example, FIG. 15 also shows one with no apparent air duct. Air blows out through fan blades, and small holes are provided near there. That is all. Thus, it is extreme, but the same effect can be achieved if a fan blade contains small holes on itself and if the fan can make air flow through the small holes.

Embodiment 8

Figure 17:
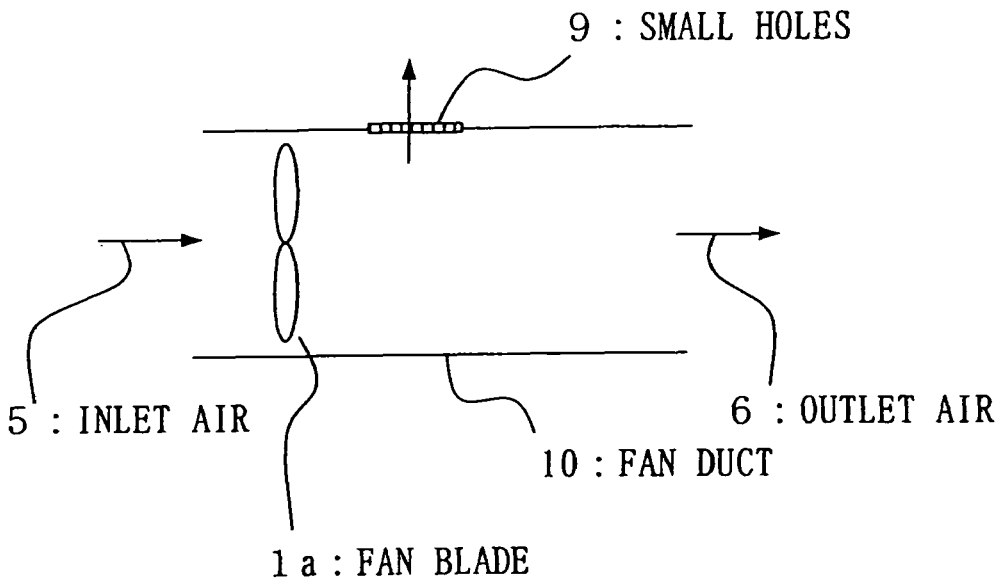
FIG. 17 is a block diagram of fan equipment illustrating a noise reduction method according to an eighth embodiment.
Figure 18:
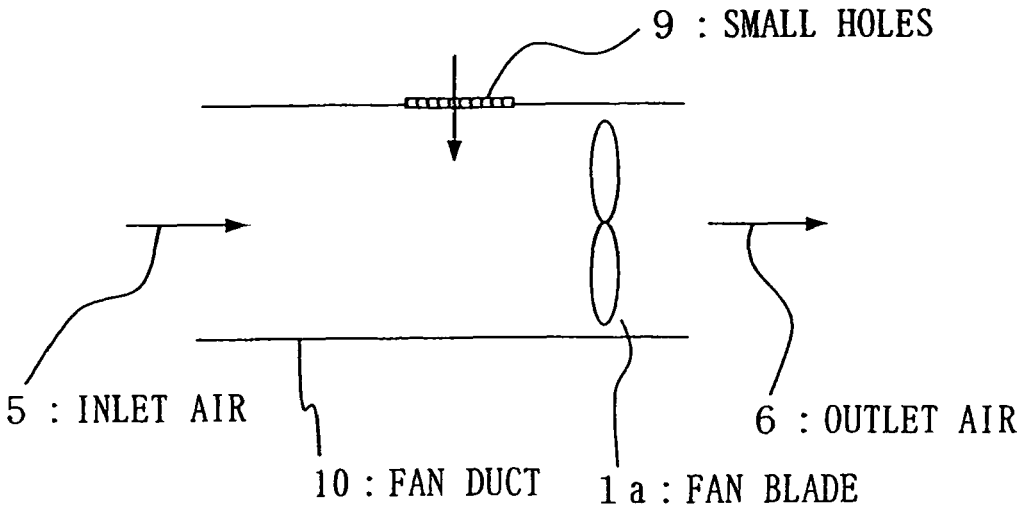
FIG. 18 is another block diagram of fan equipment illustrating the noise reduction method according to the eighth embodiment.

FIG. 17 and FIG. 18 are bock diagrams of fan equipment illustrating a noise reduction method according to an eighth embodiment. As the figures show, a fan 1 is installed in a fan duct 10. Inlet air 5 is sucked in by the fan 1. Outlet air 6 is blown out from the fan 1. Small holes 9 are provided on the wall of the fan duct 10.

When the thus configured fan equipment starts operating, the inlet air 5 is sucked in on one side of the fan duct by the induction effect of the fan 1, and blown out to the outside of the fan duct 10 as the outlet air 6. FIG. 17 shows that the fan 1 is located on the entrance side of the fan duct 10 and the distance between the fan 1 and the outlet air 6 is substantially long. FIG. 18 shows, on the other hand, that the fan 1 is located on the exit side of the fan duct 10 and the distance between the inlet air 5 and the fan 1 is substantially long.

It should be noted that the pressure difference between the blow side and the suction side of the fan 1, the relation between the fan rotational speed and pressure, the types of noise produced in the housing, the relation between the acoustic wave and the compressional wave, the nature of the jet flow, and so forth have already been discussed in the first embodiment, and therefore the discussion will not be repeated here.

With the fan equipment shown in FIG. 17, the distance between the fan 1 and the outlet air 6 is substantially long. Therefore, some pressure difference is secured between air pressure near the air outlet of the fan 1 in the fan duct 10 and air pressure outside the fan duct 10 (no more pressure than the inlet air). Small holes 9 provided on the wall of the fan duct 10 near the air outlet of the fan 1 alone allow air to flow through the small holes 9 from the inside to the outside of the fan duct. This reduces noise towards the blow side of the fan 1. For the noise reduction mechanism, refer to the first embodiment.

With the fan equipment shown in FIG. 18, the distance between the inlet air 5 and the fan 1 is substantially long. Therefore, some pressure difference is secured between air pressure near the air inlet of the fan 1 in the fan duct 10 and air pressure outside the fan duct 10 (no more pressure than the outlet air). Small holes 9 provided on the wall of the fan duct 10 near the air outlet of the fan 1 alone allow air to flow through the small holes from the outside to the inside of the fan duct. This reduces noise towards the suction side of the fan 1. For the noise reduction mechanism, refer to the first embodiment.

It should be noted that if the length of the duct is substantially long, the duct is so long that some pressure difference occurs between the inside and the outside of the duct, which allows airflow through the small holes. In such a case where fan rotation speed is high and wind speed is high, the duct of no more than 5 cm long, for example, can be substantially long if a pressure difference occurs.

With further reference to this noise reduction method, the noise reduction effect can be achieved with any open area ratio of the small hole (that is defined as the total open area of the small hole for a given area of the duct wall). Theoretically, however, to achieve the same noise reduction effect, if the open area ratio of the small hole is high, then the speed of air through the hole must be high. Practically, therefore, a low open area ratio is desirable when considering the feasible pressure difference of actual equipment. In addition, if the open area ratio of the small hole is high, then the amount of bypassing air becomes large which causes a substantial loss. This also shows that a low open area ratio is desirable. Consequently, the most desirable open area ratio of the small hole is as small as 1% or 2%. For practical purposes, however, an open area ratio up to 10% is considered acceptable for the small hole.

With further reference to this noise reduction method, any shape can be used for the diameter of the small hole. However, available pressure for the fan is limited. For all of these reasons, therefore, it is desirable to keep the same open area of the small hole for practical purposes. If the diameter of the small hole is large, however, the number of the small holes must be reduced to keep the same open area ratio of the small hole. Because a vortex occurs at the end of the small hole, and a jet angle formed by a jet blow is constant, if the diameter of the small hole is large, then the effective range of the jet flow gets narrow. This lowers the effect on noise reduction. Thus, the most desirable size of the diameter of the small hole is as small as 1 mm or 2 mm. For practical purposes, however, a diameter up to 10 mm is considered acceptable for the small hole.

Furthermore, a description has been given here with reference to the case of circulating air by the fan 1 as an example. The same can be applied to other media: water may be circulated by a pump, and refrigerant may be circulated by a compressor, for example.

Embodiment 9

Figure 19:
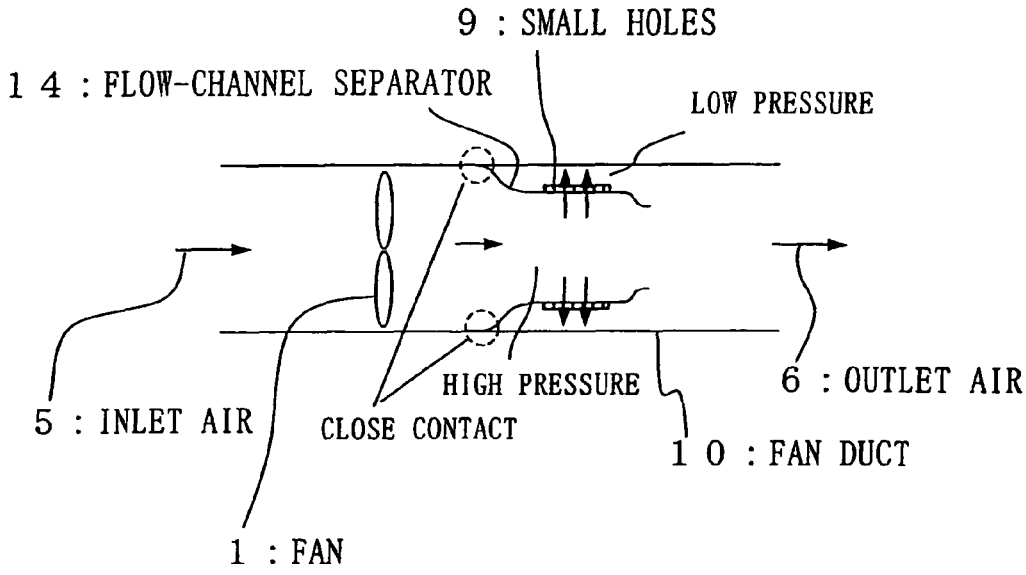
FIG. 19 is a block diagram of fan equipment illustrating a noise reduction method according to a ninth embodiment.

FIG. 19 is a block diagram of fan equipment illustrating a noise reduction method according to a ninth embodiment. As shown in the figure, a fan duct 10 contains a fan 1 and a flow-channel separator 14. The flow-channel separator 14 is in contact with the fan duct 10 on the upstream side. On the downstream side, it forms into a nozzle so that air blows from the fan 1 through the flow channel narrowed a little. Additionally, the flow-channel separator 14 contains small holes 9 in large number on the duct wall before the nozzle portion.

With the cross-sectional shape of the fan duct 10, any shape such as circle or rectangle may be employed. With the cross-sectional shape of the flow-channel separator 14, the shape may be the same as or different from that of the fan duct 10.

When the thus configured fan equipment starts operating, inlet air 5 is sucked in from one side of the fan duct by the inducing effect of the fan 1, and increased in pressure by the fan. Thereafter, at the nozzle portion of the flow-channel separator 14, the air is reduced in pressure and then blown out. This results in causing a pressure difference between before and after the nozzle portion of the flow-channel separator 14. This causes a pressure difference between both ends of the small holes 9 provided on the duct wall of the flow-channel separator 14 before the nozzle portion. This allows air to flow through the small holes 9. The air then meets air that has been blown out from the nozzle, and is blown outside the fan duct 10 as outlet air 6. Therefore, from the same principle as that discussed in the first embodiment, noise propagated from the inflow side of the flow-channel separator 14 (including the generated sound of the fan 1) is reduced where the small holes 9 are provided.

Figure 20:
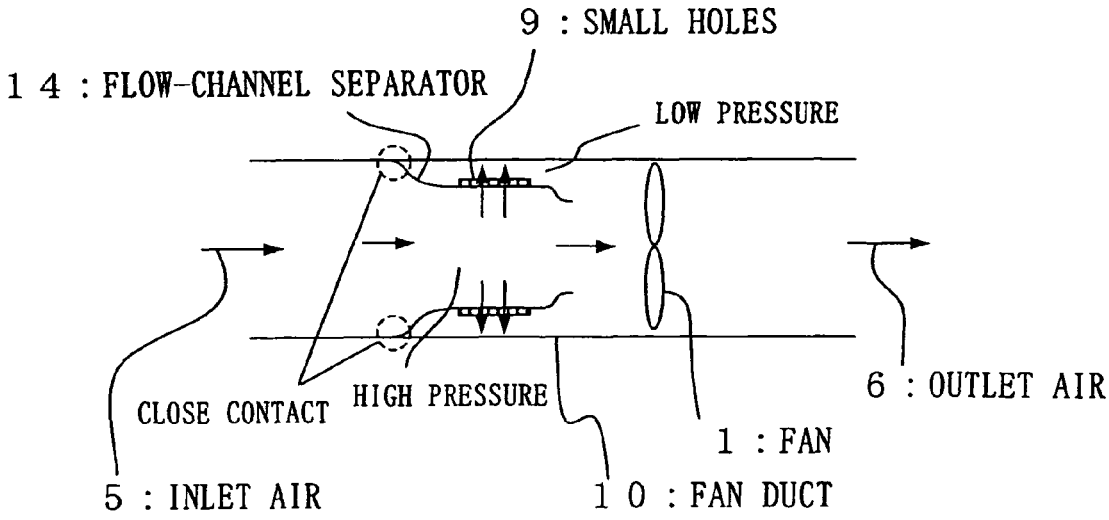
FIG. 20 is another block diagram of fan equipment illustrating the noise reduction method according to the ninth embodiment.

Alternatively, as shown in FIG. 20, the flow-channel separator 14 and the small holes 9 may be provided on the suction side of the fan 1. This allows reducing noise propagated to the suction side of the fan. Otherwise, FIG. 19 and FIG. 20 may be incorporated, so that the flow-channel separator 14 and the small holes 9 are provided on the suction side and the exit side of the fan. This allows reducing noise propagated to the suction side and the blow side of the fan.

With further reference to this noise reduction method, the noise reduction effect can be achieved with any open area ratio of the small hole (that is defined as the total open area of the small hole for a given area of the duct wall). Theoretically, however, to achieve the same noise reduction effect, if the open area ratio of the small hole is high, then the speed of air through the hole must be high. Practically, therefore, when considering the feasible pressure difference of actual equipment, the most desirable open area ratio of the small hole is as small as 1% or 2%. For practical purposes, however, an open area ratio up to 10% is considered acceptable for the small hole.

With further reference to this noise reduction method, any size can be used for the diameter of the small hole. However, available pressure for the fan is limited. For all of these reasons, therefore, it is desirable to keep the same open area of the small hole for practical purposes. If the diameter of the small hole is large, however, the number of the small holes must be reduced to keep the same open area ratio of the small hole. Because a vortex occurs at the end of the small hole, and a jet angle formed by a jet blow is constant, if the diameter of the small hole is large, then the effective range of the jet flow gets narrow. This lowers the effect on noise reduction. Thus, the most desirable size of the diameter of the small hole is as small as 1 mm or 2 mm. For practical purposes, however, a diameter up to 10 mm is considered acceptable for the small hole.

In addition, a description has been given here with reference to the example where the flow-channel separator 14 gradually narrows the air duct so as to blow air through the nozzle. However, this is not the only possibility. An orifice shape is one possibility so as to narrow the flow channel abruptly. A projection may be provided at a tip of the nozzle so as to promote flow dispersion. Thus, any shape can be used.

In addition, a description has been given here with reference to the example of a single nozzle. Alternatively, however, a plurality of small perforated ducts may be provided as shown in FIG. 12. This allows for higher noise reduction.

Furthermore, a description has been given here with reference to the case of circulating air by the fan 1 as an example. The same can be applied to other media: water may be circulated by a pump, and refrigerant may be circulated by a compressor, for example.

Embodiment 10

Figure 21:
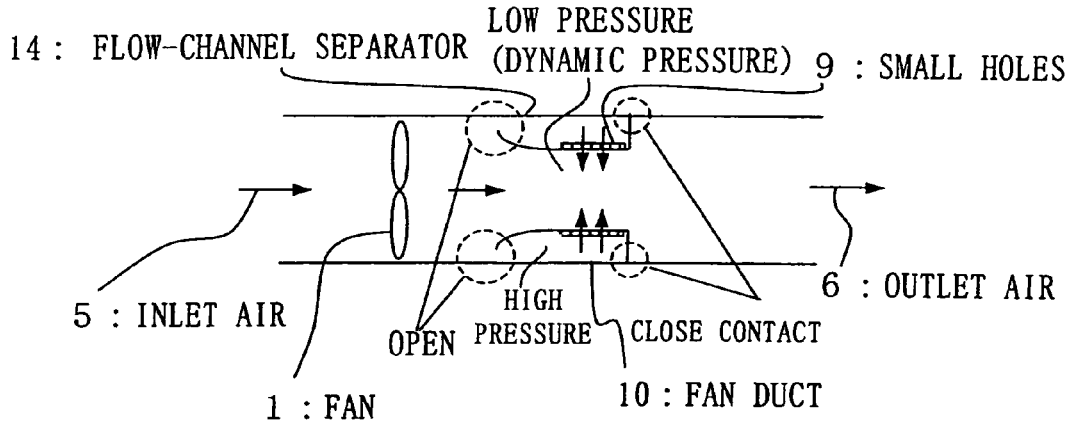
FIG. 21 is a block diagram of fan equipment illustrating a noise reduction method according to a tenth embodiment.

FIG. 21 is a block diagram of fan equipment illustrating a noise reduction method according to a tenth embodiment. As shown in the figure, a fan duct 10 contains a fan 1 and a flow-channel separator 14. The passage flow-channel separator 14 is formed to narrow the flow channel. The flow-channel separator 14 is open on the upstream side and in contact with the fan duct 10 on the downstream side. Then, the flow-channel separator 14 contains a large number of small holes 9 on the wall surrounding the flow channel narrowed.

When the thus configured fan equipment starts operating, inlet air 5 is sucked in from one side of the fan duct by the inducing effect of the fan 1, and increased in pressure by the fan. Thereafter, the air passes through the narrowed flow channel of the flow-channel separator 14. This accelerates the flow speed. From Bernoulli's theorem in fluid dynamics, the sum of static pressure and dynamic pressure of a fluid is equal at each point of flow. Dynamic pressure is proportional to squared fluid speed. Therefore, in the narrowed flow channel, dynamic pressure occurs depending on the fluid speed. Outside the narrowed flow channel, however, there is no airflow and therefore no dynamic pressure occurs. Accordingly, static pressure outside the narrowed flow channel is higher than that in the narrowed flow channel. Consequently, static pressure at the both ends of the small holes 9 provided around the narrowed flow channel is higher outside than inside. This forms a flow through the small holes 9. Then, air blown into the narrowed flow channel through the small holes 9 meets air through the narrowed flow channel, and is then blown outside from the fan duct 10 as outlet air 6. Therefore, from the same principle as that discussed in the first embodiment, noise propagated from the inflow side of the flow-channel separator 14 (including the generated sound of the fan 1) is reduced where the small holes 9 are provided.

Figure 22:
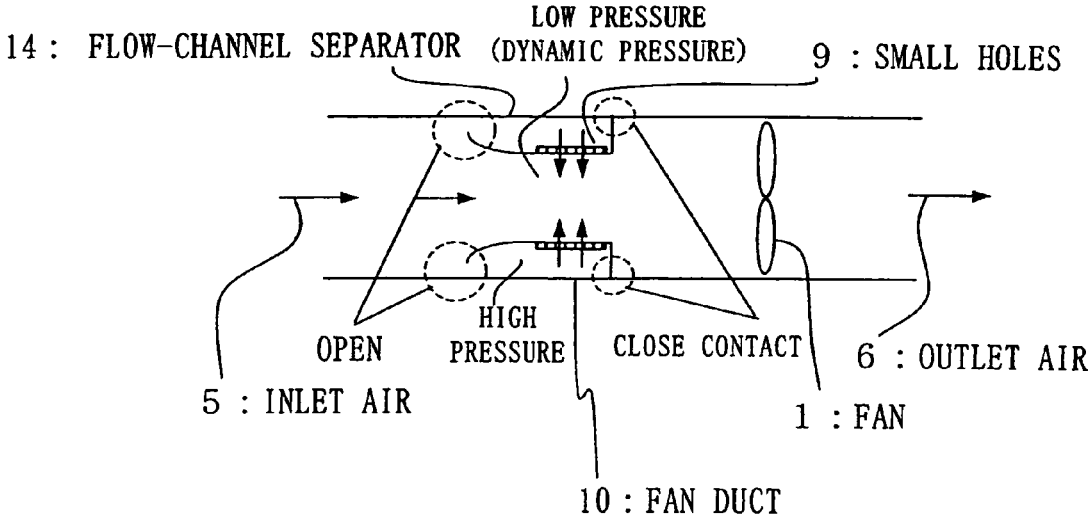
FIG. 22 is another block diagram of fan equipment illustrating the noise reduction method according to the tenth embodiment.

Alternatively, as shown in FIG. 22, the flow-channel separator 14 and the small holes 9 may be provided on the suction side of the fan 1. This allows reducing noise propagated to the suction side of the fan. Otherwise, FIG. 21 and FIG. 22 may be incorporated, so that the flow-channel separator 14 and the small holes 9 are provided on the suction side and the exit side of the fan. This allows reducing noise propagated to the suction side and the blow side of the fan.

With further reference to this noise reduction method, the noise reduction effect can be achieved with any open area ratio of the small hole (that is defined as the total open area of the small hole for a given area of the duct wall). Theoretically, however, to achieve the same noise reduction effect, if the open area ratio of the small hole is high, then the speed of air through the hole must be high. Practically, therefore, when considering the feasible pressure difference of actual equipment, the most desirable open area ratio of the small hole is as small as 1% or 2%. For practical purposes, however, an open area ratio up to 10% is considered acceptable for the small hole.

With further reference to this noise reduction method, any size can be used for the diameter of the small hole. However, available pressure for the fan is limited. For all of these reasons, therefore, it is desirable to keep the same open area of the small hole for practical purposes. If the diameter of the small hole is large, however, the number of the small holes must be reduced to keep the same open area ratio of the small hole. Because a vortex occurs at the end of the small hole, and a jet angle formed by a jet blow is constant, if the diameter of the small hole is large, then the effective range of the jet flow gets narrow. This lowers the effect on noise reduction. Thus, the most desirable size of the diameter of the small hole is as small as 1 mm or 2 mm. For practical purposes, however, a diameter up to 10 mm is considered acceptable for the small hole.

With further reference to FIG. 21 and FIG. 22, the flow-channel separator 14 is formed into a bell mouth shape on the upstream side. The bell mouth shape is desirable without unwanted pressure damage or hitting sound. However, since a flow through the small holes 9 is the only requirement for noise reduction, any shape can be used for the flow-channel separator 14 on the upstream side. A pointed shape is one possibility. A pipe whose diameter is the same as that of the section where the small holes 9 are provided is another possibility.

In addition, as long as the flow-channel separator 14 is in contact with the fan duct 10 on the downstream side, any shape can be used for the flow-channel separator 14 on the downstream side. For example, a bell mouth or a diffuser is used on the downstream side as well. In this case, pressure recovers on the downstream side of the flow channel. This allows reducing overall pressure damage.

Additionally, a description has been given of the example of using a single nozzle. Alternatively, however, like the case of FIG. 12, a plurality of perforated small ducts may be installed in the flow channel. This allows for higher noise reduction.

Furthermore, a description has been given here with reference to the case of circulating air by the fan 1 as an example. The same can be applied to other media: water may be circulated by a pump, and refrigerant may be circulated by a compressor, for example.

With further reference to the foregoing embodiments, descriptions have been given of noise reduction according to the present invention when applied to air conditioning equipment or fan equipment. Needless to say, however, the present invention may also be applied to other machines using fan equipment such as a vacuum cleaner.

Embodiment 11

Figure 23:
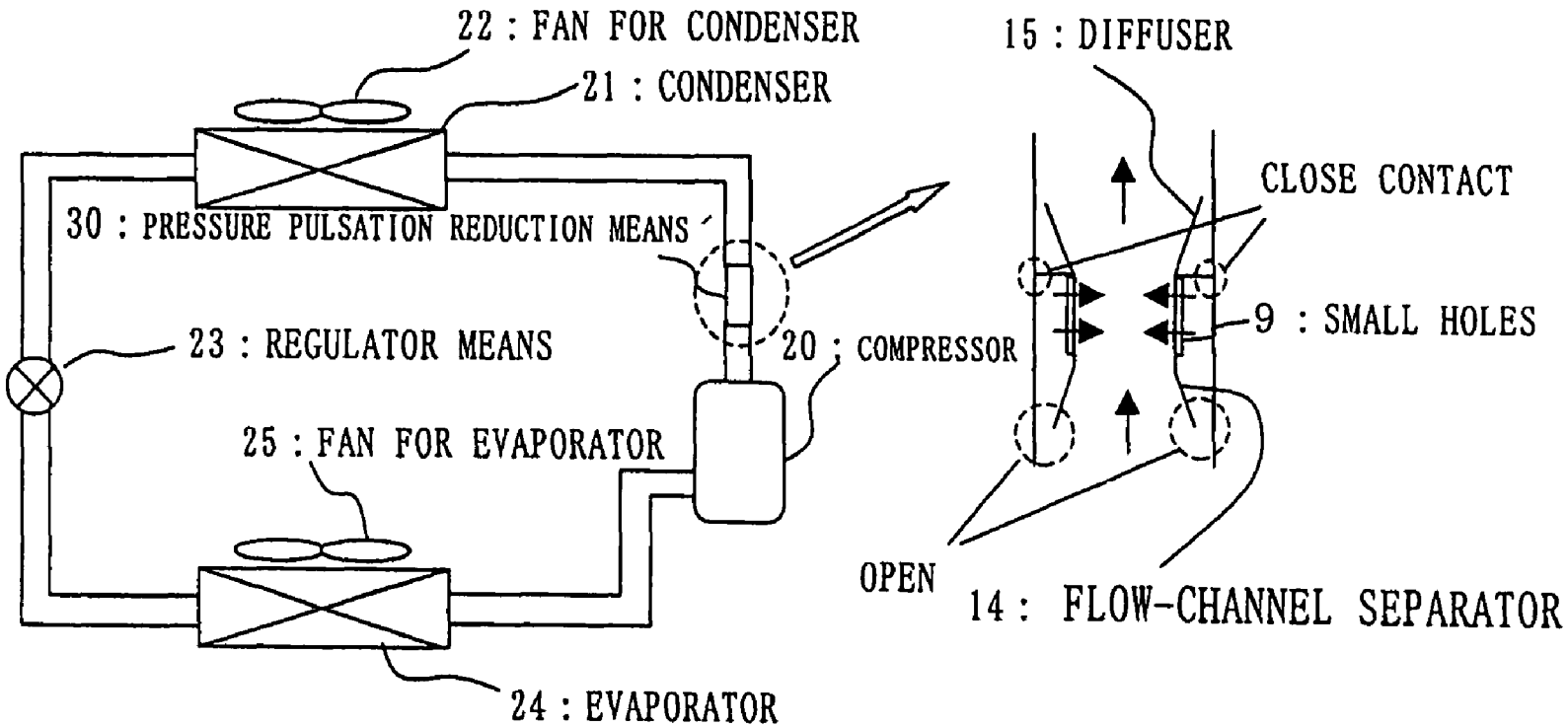
FIG. 23 is a block diagram of refrigeration cycle equipment illustrating a pressure pulsation reduction method according to an eleventh embodiment.

FIG. 23 is a block diagram of refrigeration cycle equipment illustrating a pressure pulsation reduction method according to an eleventh embodiment. As shown in the figure, high-temperature high-pressure gas refrigerant after compressed by a compressor 20 turns to liquid refrigerant when condensed in a condenser 21. Then, the liquid refrigerant is reduced in pressure in regulator means 23, evaporated in an evaporator 24, and turns to low-temperature low-pressure gas refrigerant. Then, the gas refrigerant is sucked in by the compressor 20.

The compressor 20 contains an electric drive motor and is configured as follows. Motor rotation influences rotor rotation, along with which the clearance volume of a compression chamber varies. Fluid sucked in by the compression chamber is compressed and acquires specified pressure or specified rotation angle. The fluid is discharged at once thereafter from the compressor. Therefore, the pressure of the fluid discharged from the compressor 20 also contains a pulsation component including a higher harmonic wave component when the fundamental frequency is the rotational frequency of the compressor. Also, needless to mention that the pressure of the compressor on the suction side also contains the pulsation component including the higher harmonic wave component when the fundamental frequency is the rotational frequency of the compressor.

Propagation of this pressure pulsation vibrates the condenser 21, a regulator means 23, the evaporator 24, or pipelines connecting these units, thus being the source of noise in the surroundings. Therefore, pressure pulsation means needs to be installed in a flow channel near the compressor 20 so as to reduce pressure pulsation.

It is should be noted that if a fluid includes pressure pulsation, the pressure of the fluid fluctuates periodically to the plus or minus side of the steady state pressure.

In the meantime, recent studies have shown that a jet flow of a fluid that is blown out through small holes at some speed allows for pressure pulsation reduction. The pressure pulsation reduction mechanism includes various theories, and a full elucidation of the mechanism has not been reached yet. "Attenuation of sound in a low Mach number nozzle flow" written by M. S. Howe, and published on pages 209-229 of "Journal of Fluid Mechanics" issued in 1979 describes that part of jet energy is used as energy for vortex generation. A description will be given below with reference to FIG. 24 to FIG. 26 of a pressure pulsation reduction mechanism by vortices based on this phenomenon.

Figure 24:
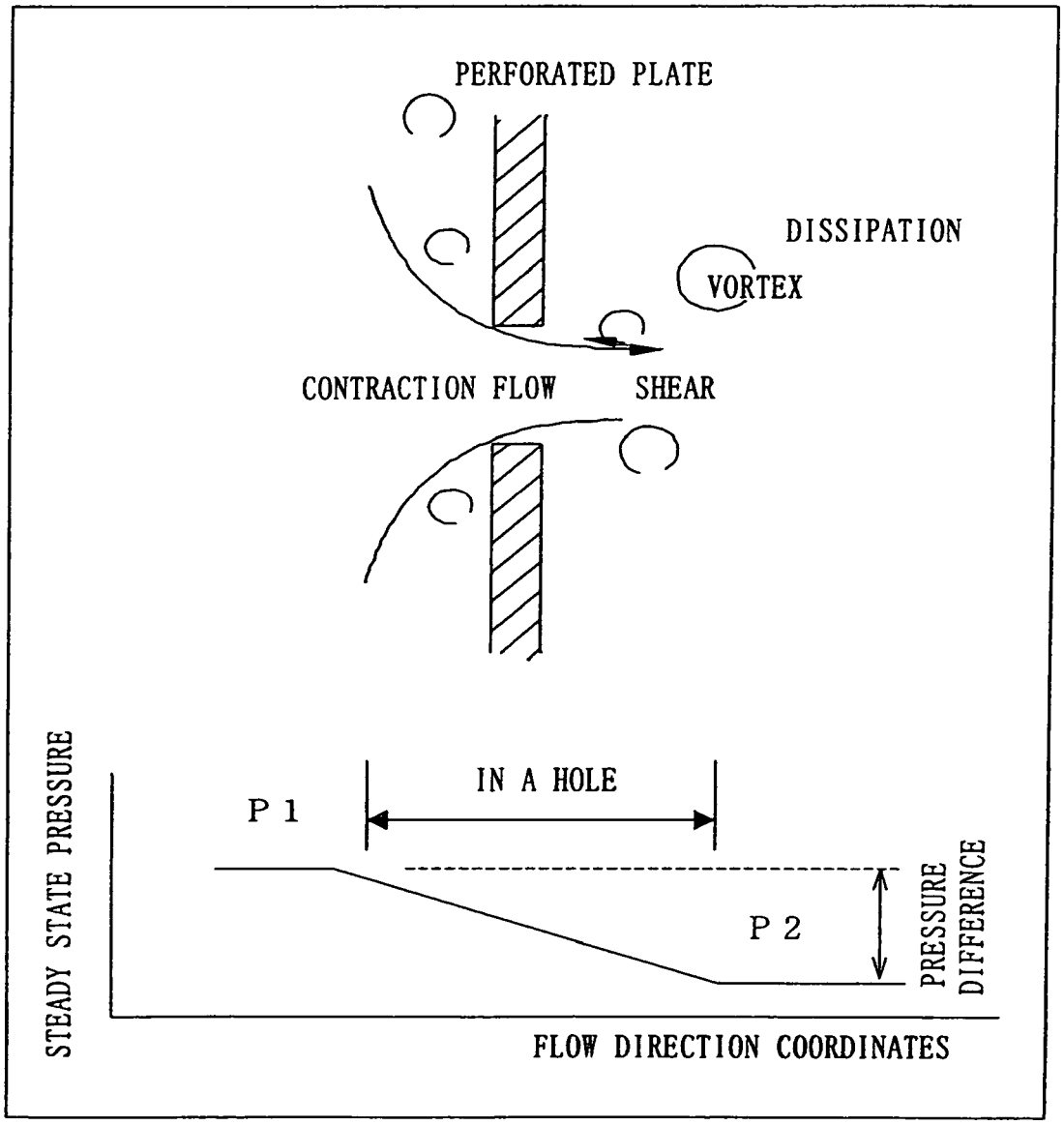
FIG. 24 is a diagram illustrating a principle of pressure pulsation reduction using small holes according to the eleventh embodiment.

A pressure difference between both ends of a perforated plate forms a contraction flow through the holes according to the pressure difference (FIG. 24). As a result, according to the Howe's paper, on the downstream side of the contraction flow, shear effect in the surrounding fluid converts part of the energy of the contraction flow into vortex energy, thereby generating a vortex. The bigger the deference between the speed of the contraction flow and the speed of the surrounding fluid, the stronger the shear effect. A generated vortex is swept away from the holes by the contraction flow. Then, in the transfer process, it is converted into thermal energy, that is, temperature rise of the surrounding fluid, and pressure energy, that is, pulsation component release to the surrounding fluid when influenced by shearing and friction in the surrounding fluid. Finally, the vortex dissipates. In other words, near the contraction flow, a series of this vortex generation and dissipation are repeated continuously. This creates space of pulsation including contraction flows and vortices around the holes. The dimension of a vortex generated by the contraction flow at the holes depends upon a diameter d of the hole. A frequency f of pressure pulsation generated by a vortex is expressed as:

$$f \propto U/d$$

where U denotes the speed of the contraction flow, so that the generation period of a vortex is 1/f.

Figure 25:
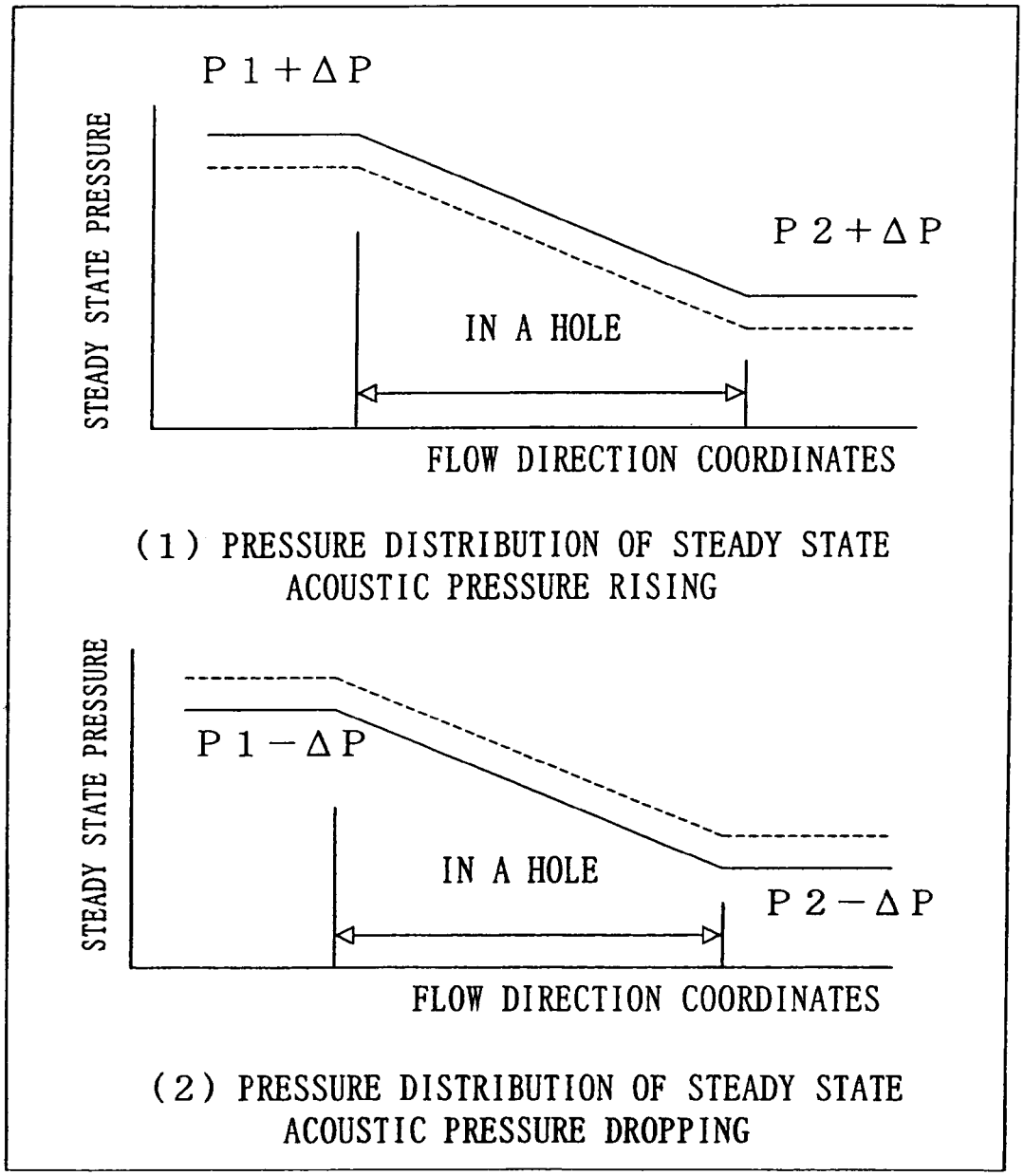
FIG. 25 is another diagram illustrating the principle of pressure pulsation reduction using small holes according to the eleventh embodiment.

Now, it is assumed that pressure pulsation whose wavelength λ is considerably longer than the diameter of the hole (λ>>d) enters near the contraction flow. As referred to earlier, pressure pulsation fluctuates periodically to the plus or minus side of the steady state pressure. Thus, if the high or low pressure components of this pressure pulsation enters near the contraction flow, the steady state pressure rises on the upstream side and drops on the downstream side of the holes at the instant of vortex generation as shown in FIG. 25.

In the case where the high pressure components of the pressure pulsation enters, so that the steady state pressure rises (FIG. 23 (1)), the amount of pressure fluctuation is the same on both sides of the holes, and the pressure difference between before and after the holes is fixed. However, when pressure rises, then a steady state density p rises accordingly. The steady state speed U of the contraction flow is expressed from Bernoulli's theorem as:

$$U \propto \sqrt{\frac{P1 - P2}{\rho}}$$

where P1 and P2 denote pressures on both sides of the holes. When the steady state density p rises, then the steady state speed U drops. Thus, when the steady state pressure rises, that is, pressure fluctuation ΔP>0, the steady state speed drops, that is, speed fluctuation ΔU<0.

To the contrary, in the case where the low pressure components of pressure pulsation enters, so that the steady state pressure drops (FIG. 25 (2)), the pressure difference is constant and the steady state density drops likewise. Therefore, the speed of the contraction flow increases. Thus, when the pressure drops, that is, pressure fluctuation ΔP<0, the steady state speed increases, that is, speed fluctuation ΔU>0.

Mechanical energy E in the space near the holes is obtained by one cycle of integration of the product of pressure fluctuation ΔP and speed fluctuation ΔU from Newton's Second Law. This is expressed as:

$$E = \int (\Delta P \cdot \Delta U) \cdot dt$$

Figure 26:
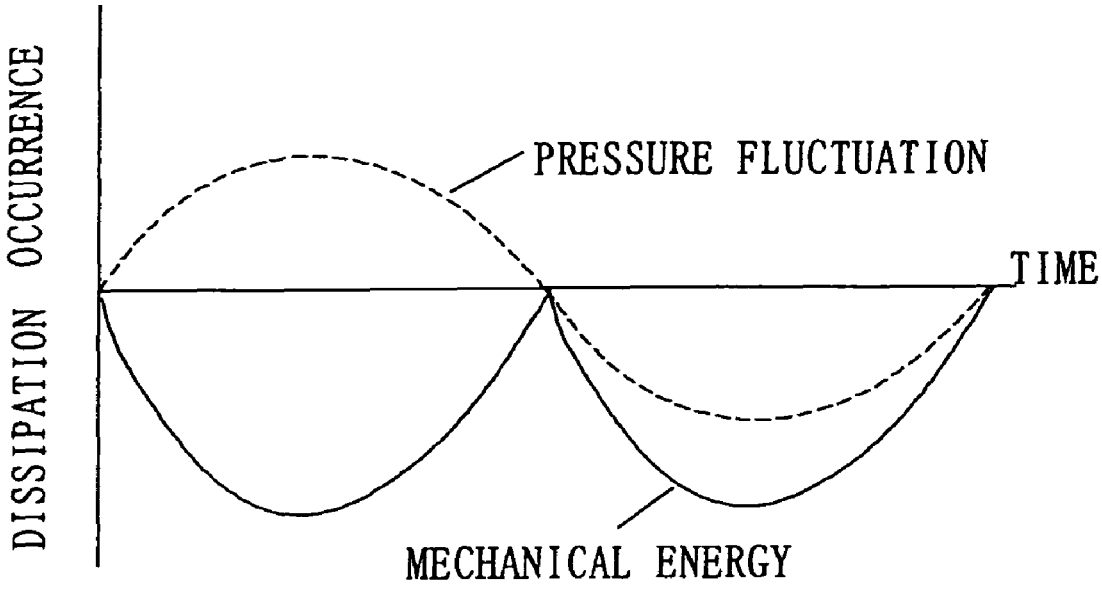
FIG. 26 is another diagram illustrating the principle of pressure pulsation reduction using small holes according to the eleventh embodiment.

Therefore, as referred to earlier, when ΔP>0, then ΔU<0, and when ΔP<0, then ΔU>0. Thus, the mechanical energy E is always negative (FIG. 26). Negative mechanical energy means that the pressure pulsation energy dissipates and the pulsation energy drops or the pressure pulsation drops.

Now, the pressure pulsation reduction effect based on this principle is premised on that the pressure fluctuation cycle is considerably slower than the speed of vortex generation by the contraction flow. Then, the effect is especially high in the low frequency range.

Figure 27:
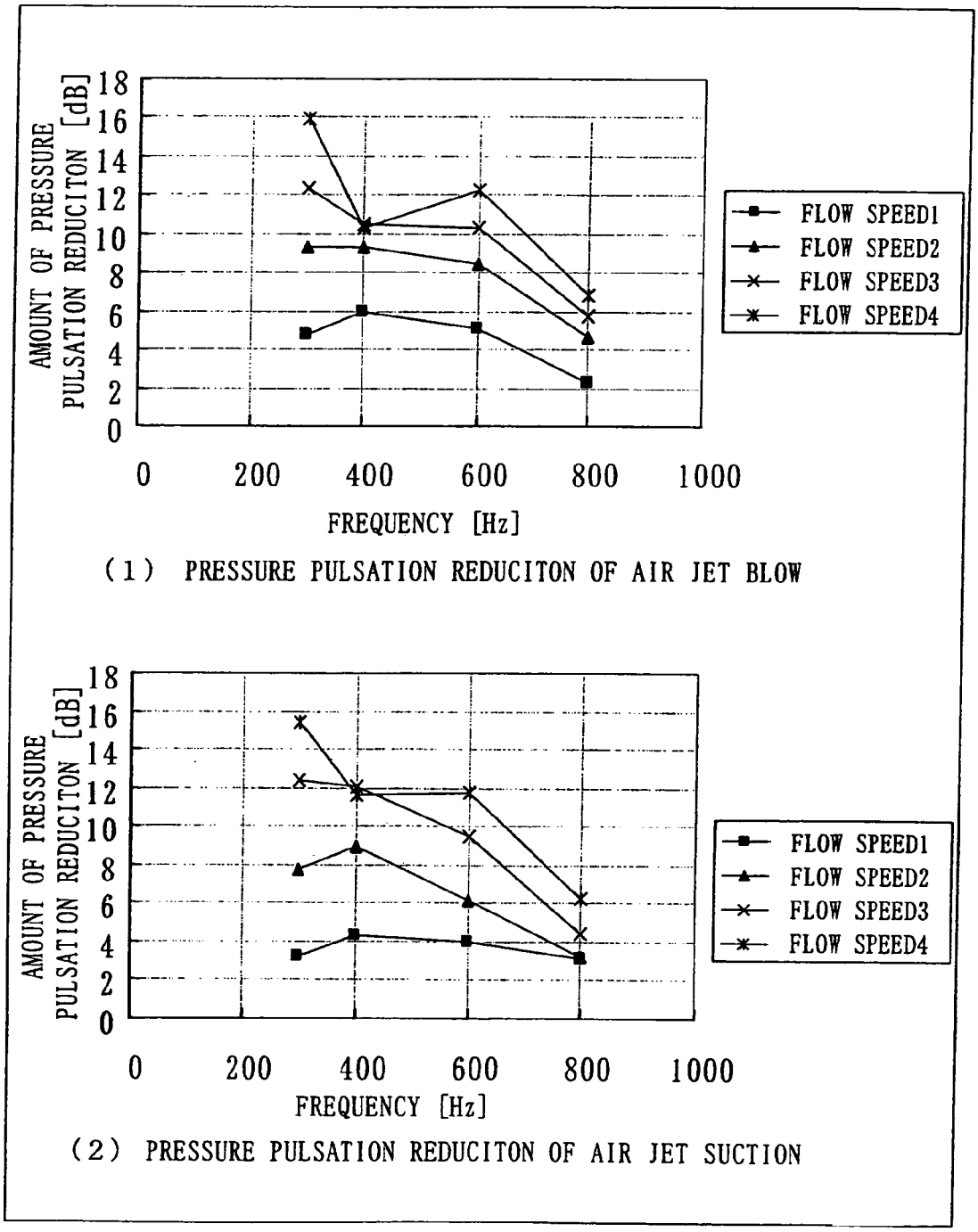
FIG. 27 is a diagram illustrating an experimental result of pressure pulsation reduction based on the pressure pulsation reduction method of refrigeration cycle equipment according to the eleventh embodiment.

FIG. 27 shows experimental results that confirmed the effect of the pressure pulsation reduction method of the present invention. More specifically, the figure shows a measured amount of pressure pulsation reduction in the case of no jet flow existing under the following condition: the perforated plate is installed in a flow channel through which pressure pulsation propagates; a jet flow is supplied to the flow channel through the holes of the perforated plate; and the frequency of the pressure pulsation and the speed of the jet flow are fluctuated. With referring to FIG. 27, the horizontal axis shows the pressure pulsation frequency and the vertical axis shows the amount of pressure pulsation reduction. FIG. 27 (1) shows the experimental result of the case where the jet flow is blown out to a field where acoustic waves propagate. FIG. 27 (2) shows the experimental result of the case where the jet flow is sucked in. It should be noted that the speed of the jet flow shown in the figure has the following relation:

Flow speed 1<Flow speed 2<Flow speed 3<Flow speed 4.

This shows that the pressure pulsation reduction effect is sufficient in the low frequency range of 1 kHz or below. It also shows that higher the jet speed, the stronger the pressure pulsation reduction effect. It also shows that the same noise reduction effects can be achieved if a jet is blown out to a fluid through which pressure pulsation propagates, or if a fluid through which pressure pulsation propagates is sucked from outside.

It is also shown from other experimental results that a smaller diameter of the hole is desirable.

With further reference to FIG. 23 discussed earlier, on the discharge side of the compressor 20 in the refrigeration cycle, pressure pulsation reduction means 30 to which the aforementioned mechanism is applied is installed. The pressure pulsation reduction means 30 contains a flow-channel separator 14, which is formed to narrow the flow channel. The flow-channel separator 14 is open on the upstream side and in contact with the surrounding wall on the downstream side. Then, the flow-channel separator 14 contains a large number of small holes 9 on the wall surrounding the narrowed flow channel.

When the thus configured refrigeration cycle equipment starts operating, a fluid flowing into the pressure pulsation reduction means 30 passes through the narrowed flow channel of the flow-channel separator 14. This accelerates the flow speed of the fluid. From Bernoulli's theorem in fluid dynamics, the sum of static pressure and dynamic pressure of a fluid is equal at each point of flow. Dynamic pressure is proportional to squared fluid speed. Therefore, in the narrowed flow channel, dynamic pressure occurs depending on the fluid speed. Outside the narrowed flow channel, however, there is no flow and therefore no dynamic pressure occurs. Accordingly, static pressure outside the narrowed flow channel is higher than that in the narrowed flow channel. Consequently, static pressure at the both ends of the small holes 9 provided around the narrowed flow channel is higher outside than inside. This forms a flow through the small holes 9. Then, the fluid blown into the narrowed flow channel through the small holes 9 meets a fluid through the narrowed flow channel, and is then discharged from the pressure pulsation reduction means 30.

With a flow through the small holes 9, from the mechanism earlier discussed, the pressure pulsation reduction effect is obtained. Therefore, the pressure pulsation of the refrigerant flowing into the pressure pulsation reduction means 30 is reduced in pulsation in the section where the small holes 9 are provided. Reduction in the pressure pulsation of refrigerant allows preventing noise caused by pipeline vibrations.

Figure 28:
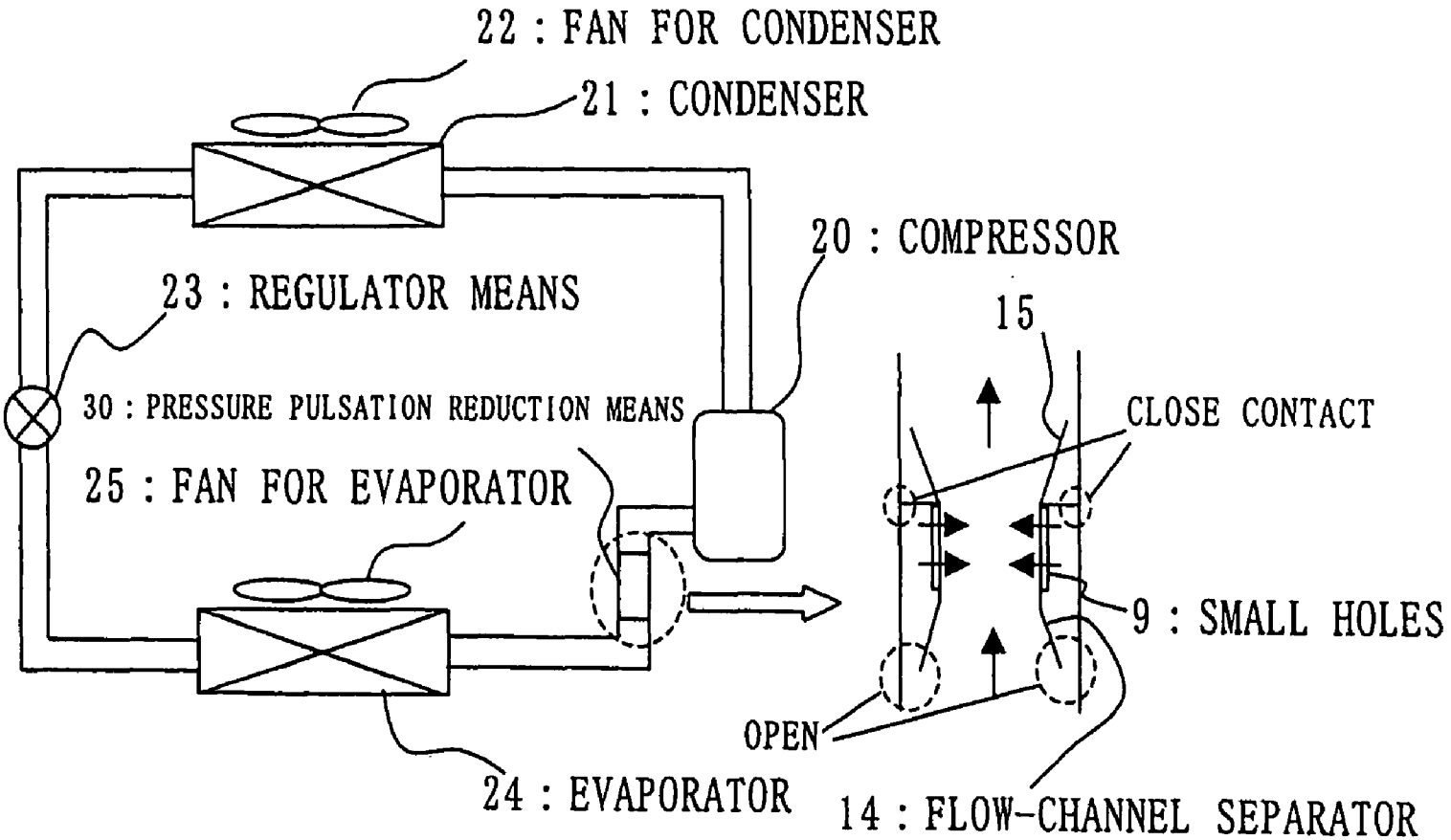
FIG. 28 is another block diagram of refrigeration cycle equipment illustrating the pressure pulsation reduction method according to the eleventh embodiment.
Figure 29:
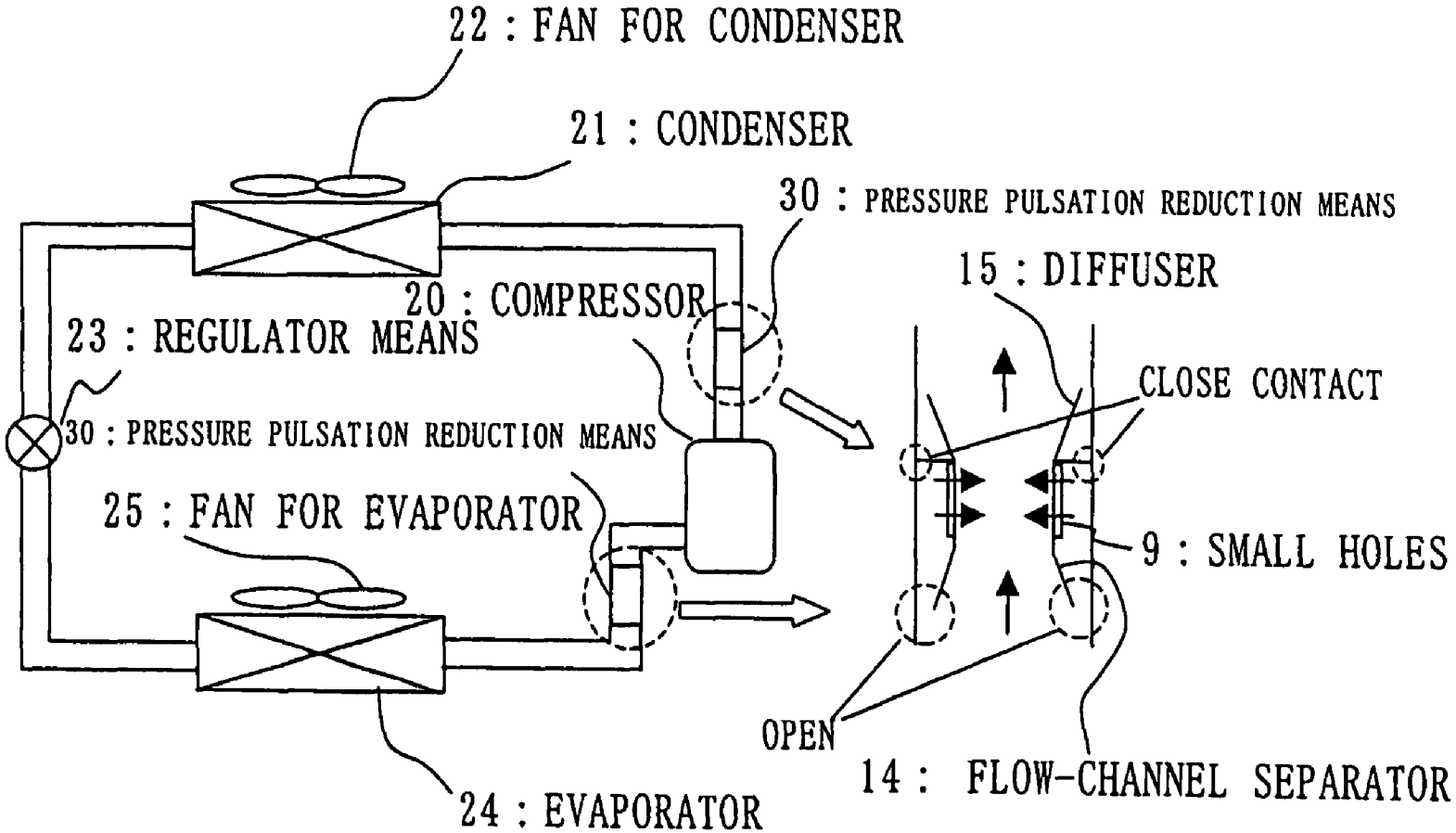
FIG. 29 is another block diagram of refrigeration cycle equipment illustrating the pressure pulsation reduction method according to the eleventh embodiment.
Figure 30:
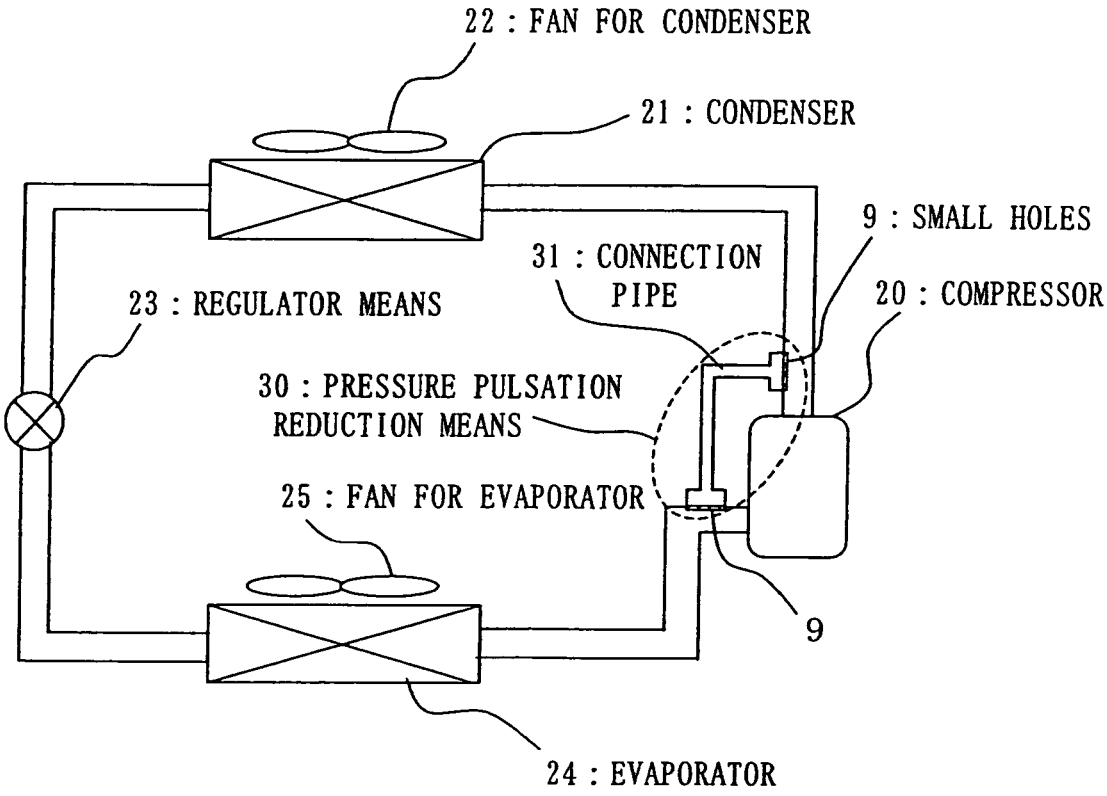
FIG. 30 is another block diagram of refrigeration cycle equipment illustrating the pressure pulsation reduction method according to the eleventh embodiment.
Figure 31:
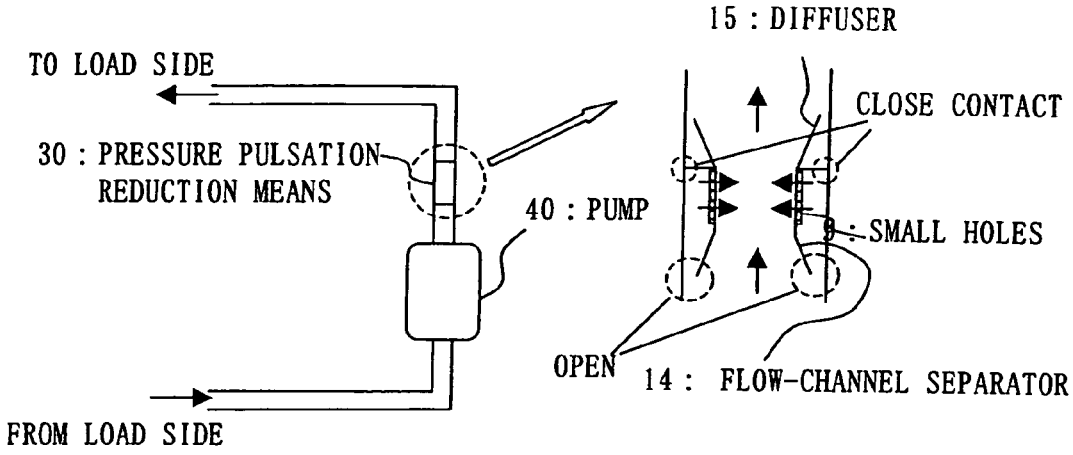
FIG. 31 is another block diagram of pump equipment illustrating the pressure pulsation reduction method according to the eleventh embodiment.
Figure 32:
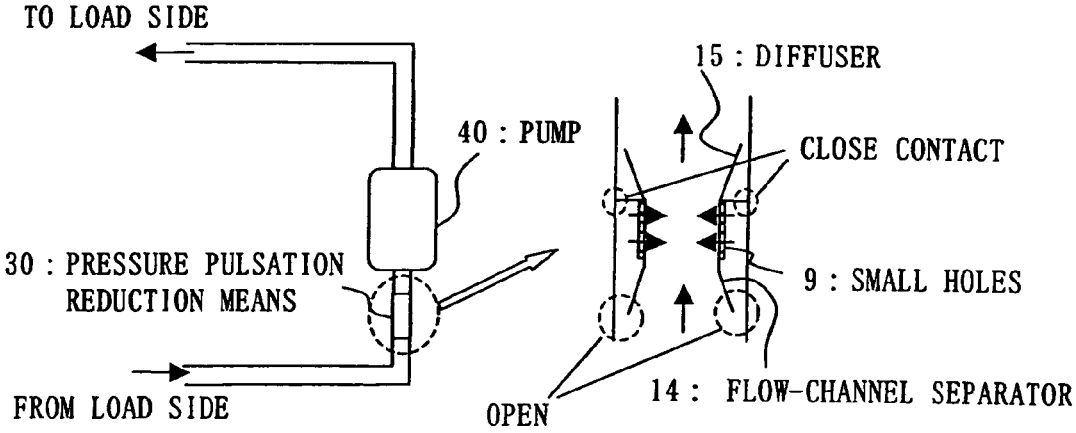
FIG. 32 is another block diagram of pump equipment illustrating the pressure pulsation reduction method according to the eleventh embodiment.
Figure 33:
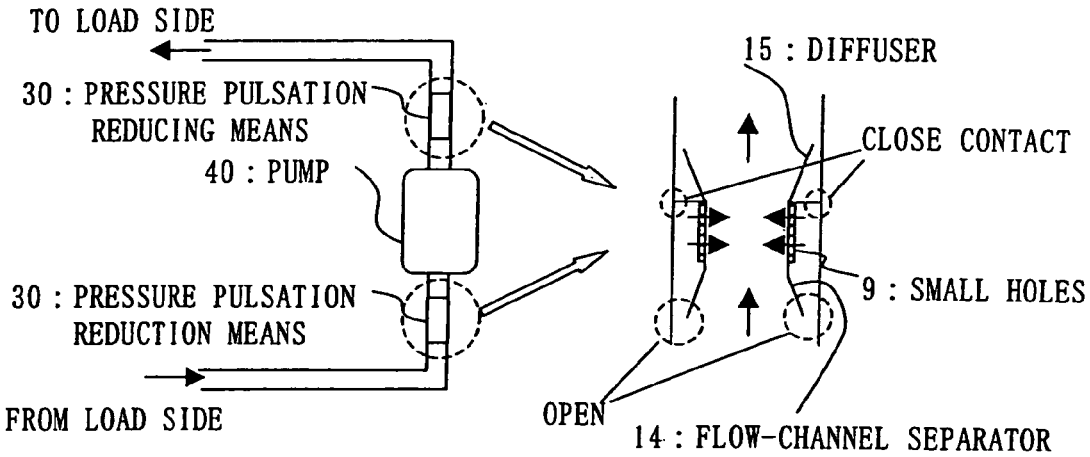
FIG. 33 is another block diagram of pump equipment illustrating the pressure pulsation reduction method according to the eleventh embodiment.
Figure 34:
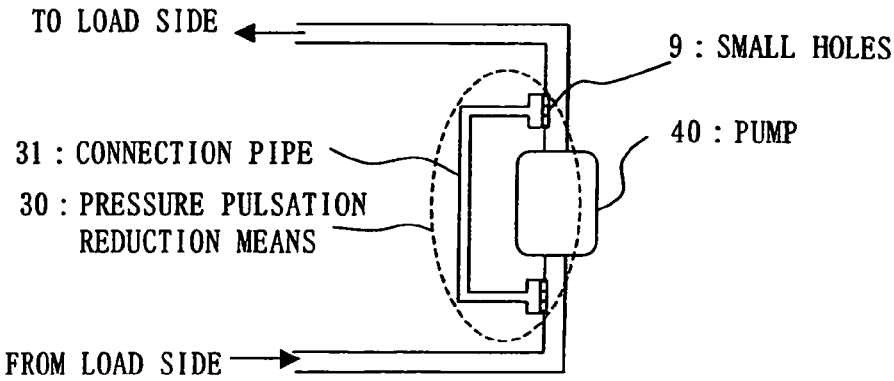
FIG. 34 is another block diagram of pump equipment illustrating the pressure pulsation reduction method according to the eleventh embodiment.

In addition, as referred to earlier, pressure pulsation occurred in the compressor 20 is propagated to the suction side. Therefore, as shown in FIG. 28, the pressure pulsation reduction means 30 may alternatively be installed on the suction side of the compressor 20. In this case, pressure pulsation reduction may be achieved on the suction side of the compressor. Otherwise, as shown in FIG. 29, the pressure pulsation reduction means 30 may be installed on the suction side and the discharge side of the compressor instead. In this case, pressure pulsation reduction propagating to both the suction side and the discharge side of the compressor may be achieved. Still alternatively, as shown in FIG. 30, the pressure pulsation reduction means 30 may be formed such that small holes 9 provided on pipeline walls on the discharge side and the suction side are connected by means of a connection pipe 31. This forms a flow from the small holes on the discharge side to the small holes on the suction side of the compressor, which allows reducing pressure pulsation on both the discharge side and the suction side.

With further reference to this pressure pulsation reduction method, the pressure pulsation reduction effect can be achieved with any open area ratio of the small hole (that is defined as the total open area of the small hole for a given area of the duct wall). Theoretically, however, to achieve the same pressure pulsation reduction effect, if the open area ratio of the small hole is high, then flow speed through the hole must be high. Practically, therefore, when considering the feasible pressure difference of actual equipment, the most desirable open area ratio of the small hole is as small as 1% or 2%. For practical purposes, however, an open area ratio up to 10% is considered acceptable for the small hole.

With further reference to this pressure pulsation reduction method, any size can be used for the diameter of the small hole. However, it is desirable to keep the same open area of the small hole for practical purposes. If the diameter of the small hole is large, the number of the small holes must be reduced to keep the same open area ratio of the small hole. Because a vortex occurs at the end of the small hole, and a jet angle formed by a jet blow is constant, if the diameter of the small hole is large, then the effective range of the jet flow gets narrow. This lowers the effect on pressure pulsation reduction. Thus, the most desirable size of the diameter of the small hole is as small as 1 mm or 2 mm. For practical purposes, however, a diameter up to 10 mm is considered acceptable for the small hole.

With further reference to FIG. 23, FIG. 28, and FIG. 29, the flow-channel separator 14 is formed into a diffuser on the upstream side. However, a flow through the small holes 9 is the only requirement for noise reduction. Thus, a pipe whose diameter is the same as that of the section where the small holes 9 are provided is one possibility, for example.

In addition, a description has been given with the example of using the diffuser on the downstream side of the flow-channel separator 14 for pressure recovery. This is not the only possibility. Any shape is possible if part of the downstream side is in contact with the surrounding wall.

In addition, a description has been given of the example of using a single nozzle. Alternatively, however, the configuration may include a plurality of perforated small ducts installed in the flow channel. This allows for higher pressure pulsation reduction.

In addition, any refrigerant can be used for the refrigerant that flows inside the refrigeration cycle equipment, for example, such as single component refrigerants like R22 etc., mixed refrigerants of a three-component system like R407C, mixed refrigerants of a two-component system like R410A, HC refrigerants such as propane etc., and natural refrigerants such as $CO_2$ etc.

In addition, the pressure pulsation reducer 30 may be applied to pump equipment as shown in FIG. 31 through FIG. 34. In this case, the pressure pulsation of a medium such as water or brine that flows through a flow channel can be reduced. The operation of this case will not be discussed here in detail, since it is the same as that of the refrigeration cycle equipment.

Embodiment 12

Pressure pulsation reduction means may be installed on either the upstream side or the downstream side of a compressing section for compressing a fluid. From the structural point of view, therefore, a compressor 20 may contain the pressure pulsation reduction means.

Figure 35:
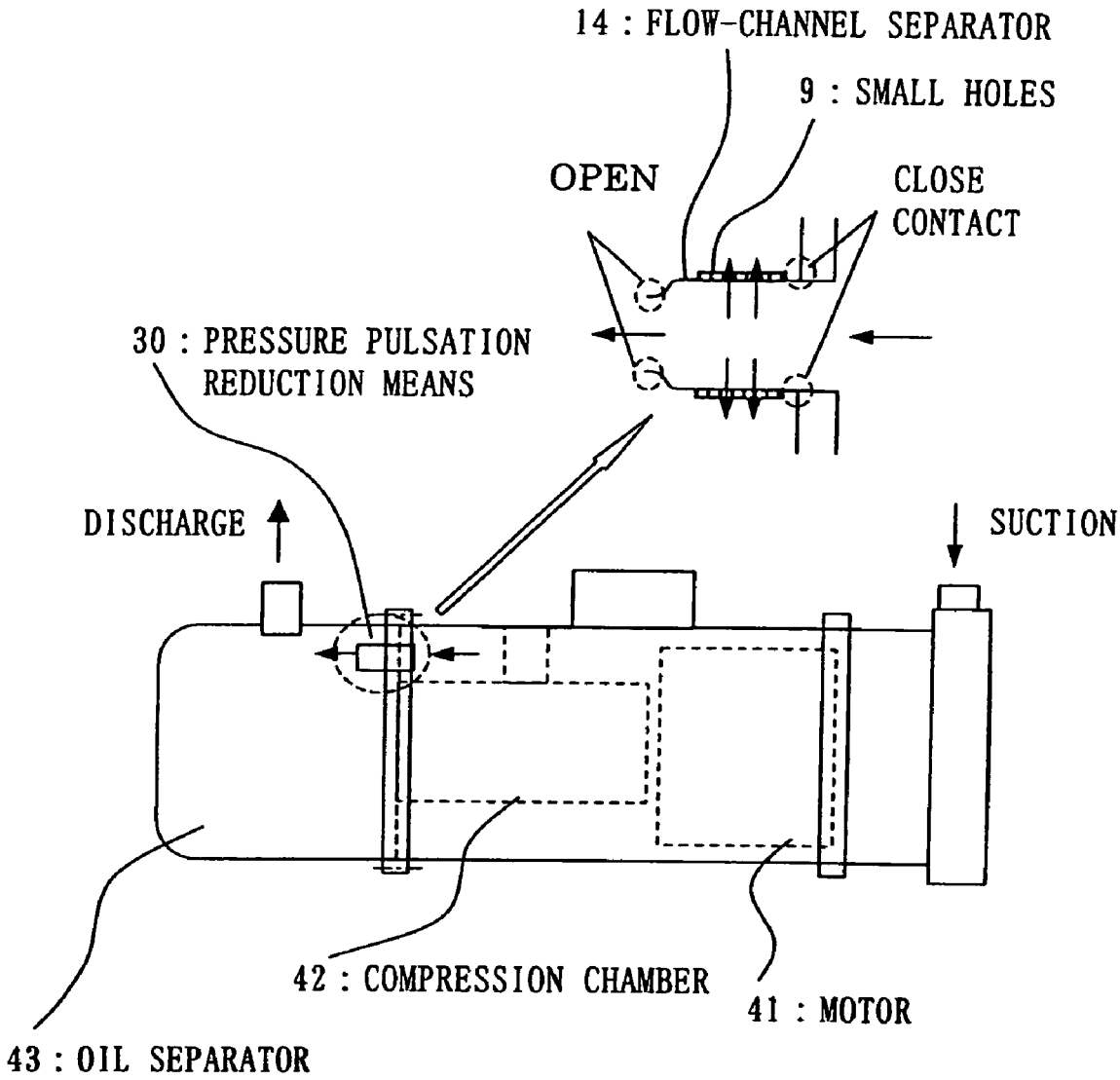
FIG. 35 is a diagram illustrating an inner structure of a single screw compressor according to a twelfth embodiment.

FIG. 35 is a diagram illustrating an internal structure of a single screw compressor according to a twelfth embodiment. Pressure pulsation reduction means 30 is installed in an oil separator 43 on the downstream side of a compression chamber 42.

With referring to the figure, a flow-channel separator 14 in the pressure pulsation reduction means 30 is in contact with the surrounding wall of the oil separator 43 on the upstream side. The flow-channel separator 14, on the downstream side, is formed into a nozzle so as to blow a fluid through a narrowed flow channel. Then, small holes 9 are provided on the duct wall of the flow-channel separator 14 before the nozzle portion. Such a configuration allows a fluid flowing into the pressure pulsation reduction means 30 to be reduced in pressure at the nozzle portion of the flow-channel separator 14 and then blown out. This causes a pressure difference between before and after the nozzle portion of the flow-channel separator 14. Consequently, a pressure difference exists between the ends of the small holes 9 provided on the duct wall of the flow-channel separator 14 before the nozzle portion. This forms a flow through the small holes 9. Thus, from the same principle as that referred to earlier, the pressure pulsation propagated from the inflow side of the flow-channel separator 14 is reduced at the section where the small holes 9 are provided.

The flow-channel separator 14 in the pressure pulsation reduction means 30 may alternatively be formed such that it is open on the upstream side, in contact with a cylindrical member that extends from the oil separator 43 and encloses the flow-channel separator 14, for example, on the downstream side, and includes small holes 9 in a large number.

INDUSTRIAL APPLICABILITY

The air conditioning equipment according to this invention includes a heat exchanger exchanging heat between refrigerant of a refrigeration cycle and air, a fan funning air to the heat exchanger, an air duct in which the fan is installed and through which an acoustic wave propagates, and a plurality of small holes blowing a jet to the air duct, and sucking a jet from the air duct according to a pressure difference between a blow side and a suction side of the fan. This allows for sufficient noise reduction in the low frequency region of a few hundred hertz or below.

The invention claimed is:

1. Pressure pulsation reduction equipment of refrigeration cycle equipment, comprising:

a refrigeration cycle including a refrigeration compressor, which is connected to a pipe that is a flow-channel; and a pressure pulsation reducer, installed on at least one of a high pressure side and a low pressure side of the refrigeration compressor, the pressure pulsation reducer including:

a flow-channel separator which separates the flow channel of the pipe into at least a first flow channel and a second flow channel; and a plurality of small holes formed on the flow-channel separator, each of the plurality of small holes being formed downstream of where the flow channel separator separates the flow channel of the pipe into at least a first flow channel and a second flow channel;

wherein the flow-channel separator has an open end on an upstream side and a closed end on a downstream side.

2. The pressure pulsation reduction equipment of refrigeration cycle equipment according to claim 1, comprising:

a pressure pulsation reducer, installed on at least one of a discharge side and a suction side of the refrigeration compressor, the pressure pulsation reducer including:

a refrigerant flow-channel separator in a refrigerant flow-channel for a refrigerant pipe which separates the refrigerant flow channel of the refrigerant pipe into at least a first refrigerant flow channel and a second refrigerant flow channel; and a plurality of small holes formed in the refrigerant flow channel separator, each of the plurality of small holes being formed downstream of where the flow channel separator separates the refrigerant flow channel of the pipe into at least a first refrigerant flow channel and a second refrigerant flow channel;

wherein the refrigerant flow-channel separator has an open end on an upstream side and a closed end on a downstream side.

3. Pressure pulsation reduction equipment of refrigeration cycle equipment, comprising:

a refrigeration cycle including a refrigeration compressor; and a pressure pulsation reducer, installed in an oil separator that is incorporated with the compressor, the pressure pulsation reducer including:

a passage which forms a flow channel through a wall of the oil separator;

a flow-channel separator which separates the flow channel into at least a first flow channel and a second flow channel, the flow through first flow channel and the flow through the second flow channel being arranged in parallel; and a plurality of small holes forms the first flow channel and an open nozzle forms the second flow channel, the open nozzle being formed downstream of the plurality of holes, wherein the open nozzle of the flow-channel separator is formed on one end of the passage on a downstream side and, the passage is in contact with the oil separator wall on another end.

4. The pressure pulsation reduction equipment of refrigeration cycle equipment according to claim 1, 2, or 3, wherein an open area ratio of the plurality of small holes is up to 10% where the open area ratio is a ratio of a total cross-sectional area of the plurality of small holes to an area of the flow-channel wall.

5. The pressure pulsation reduction equipment of refrigeration cycle equipment according to claim 1, 2, or 3, wherein a diameter of each small hole of the plurality of small holes is up to 10 mm.

* * * * *